US011484990B2

(12) United States Patent
Eckel et al.

(10) Patent No.: US 11,484,990 B2
(45) Date of Patent: Nov. 1, 2022

(54) BONDED ABRASIVE WHEEL AND METHOD OF MAKING THE SAME

(71) Applicant: 3M INNOVATIVE PROPERTIES COMPANY, St. Paul, MN (US)

(72) Inventors: Joseph B. Eckel, Vadnais Heights, MN (US); Aaron K. Nienaber, Maplewood, MN (US); Negus B. Adefris, St. Paul, MN (US); Ronald D. Jesme, Plymouth, MN (US); Thomas J. Nelson, Woodbury, MN (US); Don V. West, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 860 days.

(21) Appl. No.: 16/343,813

(22) PCT Filed: Oct. 10, 2017

(86) PCT No.: PCT/US2017/055940
§ 371 (c)(1),
(2) Date: Apr. 22, 2019

(87) PCT Pub. No.: WO2018/080784
PCT Pub. Date: May 3, 2018

(65) Prior Publication Data

US 2019/0270182 A1 Sep. 5, 2019

Related U.S. Application Data

(60) Provisional application No. 62/412,440, filed on Oct. 25, 2016.

(51) Int. Cl.
*B24D 3/34* (2006.01)
*B24D 5/14* (2006.01)
(Continued)

(52) U.S. Cl.
CPC ..... *B24D 3/346* (2013.01); *B24D 3/28* (2013.01); *B24D 5/12* (2013.01); *B24D 5/14* (2013.01);
(Continued)

(58) Field of Classification Search
None
See application file for complete search history.

(56) References Cited

U.S. PATENT DOCUMENTS 1,910,444 A * 5/1933 Nicholson ..... C09K 3/1436 51/308
1,930,788 A * 10/1933 Buckner ..... B24D 18/00 427/217
(Continued)

FOREIGN PATENT DOCUMENTS

CN 1830626 9/2006
CN 101353566 6/2011
(Continued)

OTHER PUBLICATIONS

Barbee, "Microstructure of Amorphous 304 Stainless Steel-Carbon Alloys Synthesized by Magnetron Sputter Deposition," Thin Solid Films, 1979, vol. 63, pp. 143-150.
(Continued)

*Primary Examiner* — Pegah Parvini
*Assistant Examiner* — Ross J Christie
(74) *Attorney, Agent, or Firm* — Katherine M. Scholz

(57) ABSTRACT

A bonded abrasive wheel comprises magnetizable abrasive particles retained in an organic binder. The bonded abrasive wheel has a central portion adjacent to a central hub, an outer circumference and a rotational axis extending through the central hub. The magnetizable abrasive particles adjacent to the central hub are aligned at an average angle of less than 35 degrees with respect to the rotational axis, and the
(Continued)

magnetizable abrasive particles adjacent to the outer circumference of the bonded abrasive wheel are aligned at an average angle that is from 35 and 90 degrees, inclusive, with respect to the rotational axis. Methods of making a bonded abrasive wheel are also disclosed.

20 Claims, 4 Drawing Sheets

(51) Int. Cl.

| | |
|---|---|
| ***B24D 18/00*** | (2006.01) |
| ***B24D 7/08*** | (2006.01) |
| ***B24D 3/28*** | (2006.01) |
| ***B24D 5/12*** | (2006.01) |

(52) U.S. Cl.
CPC ..... *B24D 7/08* (2013.01); *B24D 18/00* (2013.01); *B24D 18/0009* (2013.01)

(56) References Cited

U.S. PATENT DOCUMENTS

| | | | | |
|---|---|---|---|---|
| 2,370,636 | A | 3/1945 | Carlton | |
| 2,857,879 | A | 10/1958 | Johnson | |
| 2,947,616 | A | 8/1960 | Coes, Jr. | |
| 3,041,156 | A * | 6/1962 | Rowse | C09K 3/1436 51/298 |
| 3,081,584 | A | 3/1963 | Bullard | |
| 3,136,100 | A | 6/1964 | Robertson, Jr. | |
| 3,183,071 | A | 5/1965 | Rue | |
| 3,306,719 | A | 2/1967 | Fringhian | |
| 3,387,957 | A | 6/1968 | Howard | |
| 3,481,723 | A | 12/1969 | Kistler | |
| 3,495,960 | A * | 2/1970 | Schladitz | B24D 99/00 51/307 |
| 3,500,592 | A | 3/1970 | Harrist | |
| 3,596,415 | A | 8/1971 | Donahue, Jr. | |
| 3,625,666 | A | 12/1971 | James | |
| 3,918,217 | A | 11/1975 | Oliver | |
| 4,008,055 | A | 2/1977 | Phaal | |
| 4,246,004 | A | 1/1981 | Busch | |
| 4,314,827 | A | 2/1982 | Leitheiser | |
| 4,612,242 | A | 9/1986 | Vesley | |
| 4,623,364 | A | 11/1986 | Cottringer | |
| 4,652,274 | A | 3/1987 | Boettcher | |
| 4,744,802 | A | 5/1988 | Schwabel | |
| 4,751,138 | A | 6/1988 | Tumey | |
| 4,770,671 | A | 9/1988 | Monroe | |
| 4,881,951 | A | 11/1989 | Monroe | |
| 4,903,440 | A | 2/1990 | Larson | |
| 4,916,869 | A | 4/1990 | Oliver | |
| 4,985,340 | A | 1/1991 | Palazzotto | |
| 4,997,461 | A * | 3/1991 | Markhoff-Matheny | B24D 3/14 51/293 |
| 5,009,675 | A * | 4/1991 | Kunz | C04B 41/4584 51/293 |
| 5,011,508 | A * | 4/1991 | Wald | C09K 3/1418 51/293 |
| 5,042,991 | A * | 8/1991 | Kunz | C09K 3/1436 51/293 |
| 5,086,086 | A | 2/1992 | Brown-Wensley | |
| 5,152,917 | A | 10/1992 | Pieper | |
| 5,181,939 | A | 1/1993 | Neff | |
| 5,201,916 | A | 4/1993 | Berg | |
| 5,213,590 | A | 5/1993 | Neff | |
| 5,213,591 | A * | 5/1993 | Celikkaya | C09K 3/1445 51/296 |
| 5,236,472 | A | 8/1993 | Kirk | |
| 5,250,084 | A | 10/1993 | Lansell | |
| 5,352,254 | A * | 10/1994 | Celikkaya | C09K 3/1436 51/307 |
| 5,366,523 | A | 11/1994 | Rowenhorst | |
| 5,376,428 | A | 12/1994 | Palazzotto | |
| 5,380,390 | A | 1/1995 | Tselesin | |
| 5,385,954 | A | 1/1995 | Palazzotto | |
| 5,435,816 | A | 7/1995 | Spurgeon | |
| 5,500,273 | A | 3/1996 | Holmes | |
| RE35,570 | E | 7/1997 | Rowenhorst | |
| 5,672,097 | A | 9/1997 | Hoopman | |
| 5,766,277 | A | 6/1998 | DeVoe | |
| 5,817,204 | A | 10/1998 | Tselesin | |
| 5,891,204 | A | 4/1999 | Neff | |
| 5,946,991 | A | 9/1999 | Hoopman | |
| 5,975,987 | A | 11/1999 | Hoopman | |
| 5,984,988 | A | 11/1999 | Berg | |
| 6,083,631 | A | 7/2000 | Neff | |
| 6,120,568 | A | 9/2000 | Neff | |
| 6,129,540 | A | 10/2000 | Hoopman | |
| 7,727,931 | B2 | 6/2010 | Brey | |
| 8,034,137 | B2 | 10/2011 | Erickson | |
| 8,142,531 | B2 | 3/2012 | Adefris | |
| 8,142,532 | B2 | 3/2012 | Erickson | |
| 8,142,891 | B2 | 3/2012 | Culler | |
| 8,262,758 | B2 | 9/2012 | Gao | |
| 8,698,394 | B2 | 4/2014 | McCutcheon | |
| 2002/0026752 | A1 | 3/2002 | Culler | |
| 2005/0218566 | A1 | 10/2005 | Suzuki | |
| 2008/0131705 | A1 | 6/2008 | Colburn | |
| 2008/0289262 | A1 | 11/2008 | Gao | |
| 2009/0165394 | A1 | 7/2009 | Culler | |
| 2009/0169816 | A1 | 7/2009 | Erickson | |
| 2011/0088330 | A1 | 4/2011 | Beekam | |
| 2012/0227333 | A1 | 9/2012 | Adefris | |
| 2013/0040537 | A1 | 2/2013 | Schwabel | |
| 2013/0125477 | A1 | 5/2013 | Adefris | |
| 2013/0203328 | A1 | 8/2013 | Givot | |
| 2013/0244552 | A1 | 9/2013 | Lee | |
| 2013/0252521 | A1 | 9/2013 | Kasashima | |
| 2013/0252522 | A1 | 9/2013 | Kasashima | |
| 2013/0344786 | A1 | 12/2013 | Keipert | |
| 2014/0106126 | A1 | 4/2014 | Gaeta | |
| 2014/0256238 | A1 * | 9/2014 | Van | B24D 7/14 451/548 |
| 2014/0290147 | A1 | 10/2014 | Seth | |
| 2014/0291895 | A1 | 10/2014 | Kanade | |
| 2015/0291867 | A1 * | 10/2015 | Breder | B24D 3/14 51/307 |
| 2016/0289520 | A1 | 6/2016 | Bujnowski et al. | |
| 2016/0221153 | A1 | 8/2016 | Rizzo, Jr. | |

FOREIGN PATENT DOCUMENTS

| | | |
|---|---|---|
| CN | 103590090 | 2/2014 |
| CN | 104191385 | 12/2014 |
| CN | 104999385 | 10/2015 |
| DE | 3042643 | 7/1981 |
| DE | 102012221316 | 5/2014 |
| DE | 202014101741 | 6/2014 |
| DE | 102013212609 | 12/2014 |
| DE | 102013212617 | 12/2014 |
| DE | 102013212639 | 12/2014 |
| DE | 102013212666 | 12/2014 |
| DE | 102013212684 | 12/2014 |
| EP | 1122718 | 8/2011 |
| GB | 396231 | 8/1933 |
| GB | 1477767 | 6/1977 |
| JP | S63-232947 | 9/1988 |
| JP | H07-078509 | 3/1995 |
| JP | H11-165252 | 6/1999 |
| JP | 2002-053367 | 2/2002 |
| JP | 2004-098265 | 4/2004 |
| JP | 2004-098266 | 4/2004 |
| JP | 2005-153106 | 6/2005 |
| JP | 2012-131017 | 7/2012 |
| JP | 2012-131018 | 7/2012 |
| JP | 2015-155142 | 8/2015 |
| SU | 1495100 | 7/1989 |
| WO | WO 1994-027833 | 12/1994 |
| WO | WO 2010-041645 | 4/2010 |
| WO | WO 2011-109188 | 9/2011 |
| WO | WO 2012-112305 | 8/2012 |

(56) References Cited

FOREIGN PATENT DOCUMENTS

| | | |
|---|---|---|
| WO | WO 2015-100020 | 7/2015 |
| WO | WO 2015-100220 | 7/2015 |
| WO | WO 2016-044158 | 3/2016 |
| WO | WO 2016-064726 | 4/2016 |
| WO | WO 2016-081302 | 5/2016 |
| WO | WO 2017-083255 | 5/2017 |
| WO | WO 2017-136188 | 8/2017 |
| WO | WO 2018-080703 | 5/2018 |
| WO | WO 2018-080704 | 5/2018 |
| WO | WO 2018-080705 | 5/2018 |
| WO | WO 2018-080755 | 5/2018 |
| WO | WO 2018-080756 | 5/2018 |
| WO | WO 2018-080799 | 5/2018 |

OTHER PUBLICATIONS

Rampal, "Comparing the Magnetic Abrasives by Investigating the Surface Finish," Journal of Engineering, Computers & Applied Sciences (JEC&AS), Oct. 2012, vol. 1, No. 1, pp. 20-24.
International Search Report for PCT International Application No. PCT/US2017/055940, dated Jan. 2, 2018, 4 pages.

* cited by examiner

BONDED ABRASIVE WHEEL AND METHOD OF MAKING THE SAME

CROSS REFERENCE TO RELATED APPLICATIONS

This application is a national stage filing under 35 U.S.C. 371 of PCT/US2017/055940, filed Oct. 10, 2017, which claims the benefit of U.S. Application No. 62/412,440, filed Oct. 25, 2016, the disclosure of which is incorporated by reference in its entirety herein.

TECHNICAL FIELD

The present disclosure broadly relates to bonded abrasive articles and methods of making and using them.

BACKGROUND

Bonded abrasive wheels include abrasive particles bonded together by a bonding medium (i.e., a binder) in the shape of a circular wheel, typically around a central hub. Bonded abrasive wheels include, for example, grinding wheels and cut-off wheels. The bonding medium may be an organic resin (e.g., resin bond wheels), but may also be an inorganic material such as a ceramic or glass (i.e., vitreous bond wheels).

Abrasive wheels of various shapes may be driven by a stationary-mounted motor such as, for example, a bench grinder, or attached and driven by a hand-operated portable grinder. Hand-operated portable grinders are typically held at a slight angle relative to the workpiece surface, and may be used to grind, for example, welding beads, flash, gates, and risers off castings.

Grinding wheels used with handheld angle grinders are typically thin wheels of modest diameter (e.g., 4 to 9 inches (10 to 23 cm)) that resemble cut-off wheels in their construction, but in use they are contacted with the workpiece being abraded at an angle generally less than about 45 degrees, in contrast with cut-off wheels that are used at angles typically closer to 90 degrees.

Abrasive wheels that include rod-shaped abrasive particles (hereinafter "abrasive particles") are known. Certain abrasive particles are made be a sol-gel extrusion process using an alumina precursor, followed by firing the alumina precursor to form alpha alumina. For example, U.S. Pat. No. 3,183,071 (Rue et al.) and U.S. Pat. No. 3,481,723 (Kistler et al.) disclose abrasive wheels for use in heavy duty snagging operations made with extruded rod shaped polycrystalline alpha alumina abrasive grits. Kistler et al. refers broadly to the use of extruded polycrystalline sintered alumina abrasive particles with diameters of the order of about 26 to 160 mils (0.65 to 3.28 mm) which are formed by extruding a slurry of alpha $Al_2O_3$ or other suitable fine alumina containing particles which have been mixed with organic binding agents to facilitate the extrusion. Similarly. U.S. Pat. No. 3,387,957 (Howard) extrudes bauxite as small diameter straight cylindrical rods.

The orientation of abrasive particles with respect to the working (i.e., abrading) surface of the bonded abrasive wheel can be important to performance of the abrasive wheel. U.S. Pat. No. 3,495,960 (Schladitz) discloses a member formed by a bondable and solidified plastic support element for surface finishing a workpiece to provide a lustrous, transparent and shiny appearance. The member has a smooth working surface and is provided with a multiplicity of metallic magnetizable rod-shaped abrasive filaments aligned in substantial parallelism with one another within the member and generally positioned normal to the working surface to define a portion thereof.

The cutting efficiency and abrasive particle fracture mechanism varies with orientation. With abrasive particles, for improved cut and breakdown, it is generally preferred that the abrasive wheel and/or workpiece relative motion is such that an end of the elongated particle is presented at the working surface instead of the elongated abrasive particle side.

SUMMARY

Advantageously, bonded abrasive wheels according to the present disclosure may provide improvements in cut when used as a right-angle grinding wheel. Differences in the angle with the workpiece due to user preference can affect abrading performance. It would be desirable to have bonded abrasive wheels that can be used for hand grinding at multiple orientations with good abrading performance at many angles of use.

Advantageously, the present inventors have discovered a method of variably orienting the abrasive particles within a bonded abrasive wheel that can lead to substantially improved abrading performance. This variable alignment is achieved using magnetizable abrasive particles which are aligned by a magnetic field during manufacture of the bonded abrasive wheel.

In a first aspect, the present disclosure provides a bonded abrasive wheel comprising magnetizable abrasive particles retained in a first organic binder, wherein the bonded abrasive wheel has a central portion adjacent to a central hub, wherein the bonded abrasive wheel has an outer circumference and a rotational axis extending through the central hub, wherein the magnetizable abrasive particles adjacent to the central hub are aligned at an average angle of less than 35 degrees with respect to the rotational axis, and wherein the magnetizable abrasive particles adjacent to the outer circumference of the bonded abrasive wheel are aligned at an average angle that is from 35 and 90 degrees, inclusive, with respect to the rotational axis.

In a second aspect, the present disclosure further provides a method of making a bonded abrasive wheel, the method comprising steps:

a) disposing a layer of a first curable composition into a mold having a circular mold cavity with a depressed central portion adjacent to a central hub, wherein the circular mold cavity has an outer circumference and a rotational axis extending through the central hub, and wherein the curable composition comprises non-magnetizable abrasive particles dispersed in a first organic binder precursor;

b) disposing a first porous reinforcing material onto the layer of first curable composition;

c) disposing a layer of a second curable composition onto the porous reinforcing material and first curable composition, wherein the second curable composition comprises magnetizable abrasive particles dispersed in a second organic binder precursor; and d) applying a magnetic field to the curable composition such that the magnetizable abrasive particles adjacent to the central hub are aligned at an average angle of less than 35 degrees with respect to the rotational axis, and wherein the magnetizable abrasive particles adjacent to the outer circumference of the circular mold cavity are aligned at an average angle that is from 35 and 90 degrees, inclusive, with respect to the rotational axis; and e) at least partially curing the curable composition to provide the bonded abrasive wheel.

As used herein:

The term "aligned with" as used to refer to the alignment of the rotational axis of a bonded abrasive wheel, refers to the longitudinal axis in the case of a rod, and refers to the largest planar surface of in the case of a platelet.

The term "adjacent" used in reference to the central hub or outer circumference of a bonded abrasive wheel means within a distance of 10 percent of the radius of the wheel, preferably within 5 percent, and more preferably within one percent.

The term "central hub" refers to the central region of a bonded abrasive wheel that engages and/or contacts a rotatable shaft of a power tool in normal usage. Examples include an arbor hole, an arbor hole lined with a sleeve, grommet or rivet, an arbor hole filled having an insert therein, and a mechanical fastener centrally adhered to the bonded abrasive wheel.

The term "ceramic" refers to any of various hard, brittle, heat- and corrosion-resistant materials made of at least one metallic element (which may include silicon) combined with oxygen, carbon, nitrogen, or sulfur. Ceramics may be crystalline or polycrystalline, for example.

The term "ferrimagnetic" refers to materials that exhibit ferromagnetism. Ferrimagnetism is a type of permanent magnetism that occurs in solids in which the magnetic fields associated with individual atoms spontaneously align themselves, some parallel, or m the same direction (as in ferromagnetism), and others generally antiparallel, or paired off in opposite directions (as in antiferromagnetism). The magnetic behavior of single crystals of ferrimagnetic materials may be attributed to the parallel alignment; the diluting effect of those atoms in the antiparallel arrangement keeps the magnetic strength of these materials generally less than that of purely ferromagnetic solids such as metallic iron. Ferrimagnetism occurs chiefly in magnetic oxides known as ferrites. The spontaneous alignment that produces ferrimagnetism is entirely disrupted above a temperature called the Curie point, characteristic of each ferrimagnetic material. When the temperature of the material is brought below the Curie point, ferrimagnetism revives.

The term "ferromagnetic" refers to materials that exhibit ferromagnetism. Ferromagnetism is a physical phenomenon in which certain electrically uncharged materials strongly attract others. In contrast to other substances, ferromagnetic materials are magnetized easily, and in strong magnetic fields the magnetization approaches a definite limit called saturation. When a field is applied and then removed, the magnetization does not return to its original value. This phenomenon is referred to as hysteresis. When heated to a certain temperature called the Curie point, which is generally different for each substance, ferromagnetic materials lose their characteristic properties and cease to be magnetic; however, they become ferromagnetic again on cooling.

The terms "magnetic" and "magnetized" mean being ferromagnetic or ferrimagnetic at 20° C. or capable of being made so, unless otherwise specified. Preferably, magnetizable layers according to the present disclosure either have, or can be made to have by exposure to an applied magnetic field, a magnetic moment of at least 0.001 electromagnetic units (emu), more preferably at least 0.005 emu, more preferably 0.01 emu, up to an including 0.1 emu, although this is not a requirement.

The term "magnetic field" refers to magnetic fields that are not generated by any astronomical body or bodies (e.g., Earth or the sun). In general, magnetic fields used in practice of the present disclosure have a field strength in the region of the magnetizable abrasive particles being oriented of at least about 10 gauss (1 mT), preferably at least about 100 gauss (10 mT), and more preferably at least about 1000 gauss (0.1 T).

The term "magnetizable" means capable of being magnetized or already in a magnetized state.

The term "abrasive rod" refers to an abrasive particle having a length that is at least 3 times (preferably at least 5 times, at least 8 times, or even at least 10 times) its width and thickness. Rods may be cylindrical or prism-shaped (e.g., a 3-sided, 4-sided, 5-sided, or 6-sided prism), and may be tapered toward it middle or an end.

The term "shaped ceramic body" refers to a ceramic body that has been intentionally shaped (e.g., extruded, die cut, molded, screen-printed) at some point during its preparation such that the resulting ceramic body is non-randomly shaped. The term "shaped ceramic body" as used herein excludes ceramic bodies obtained by a mechanical crushing or milling operation.

The terms "precisely-shaped ceramic body" refers to a ceramic body wherein at least a portion of the ceramic body has a predetermined shape that is replicated from a mold cavity used to form a precursor precisely-shaped ceramic body that is sintered to form the precisely-shaped ceramic body.

The term "length" refers to the longest dimension of an object.

The term "width" refers to the longest dimension of an object that is perpendicular to its length.

The term "thickness" refers to the longest dimension of an object that is perpendicular to both of its length and width.

The term "aspect ratio" refers to the ratio length/thickness of an object.

The term "substantially" means within 35 percent (preferably within 30 percent, more preferably within 25 percent, more preferably within 20 percent, more preferably within 10 percent, and more preferably within 5 percent) of the attribute being referred to.

Features and advantages of the present disclosure will be further understood upon consideration of the detailed description as well as the appended claims.

Figure 1:
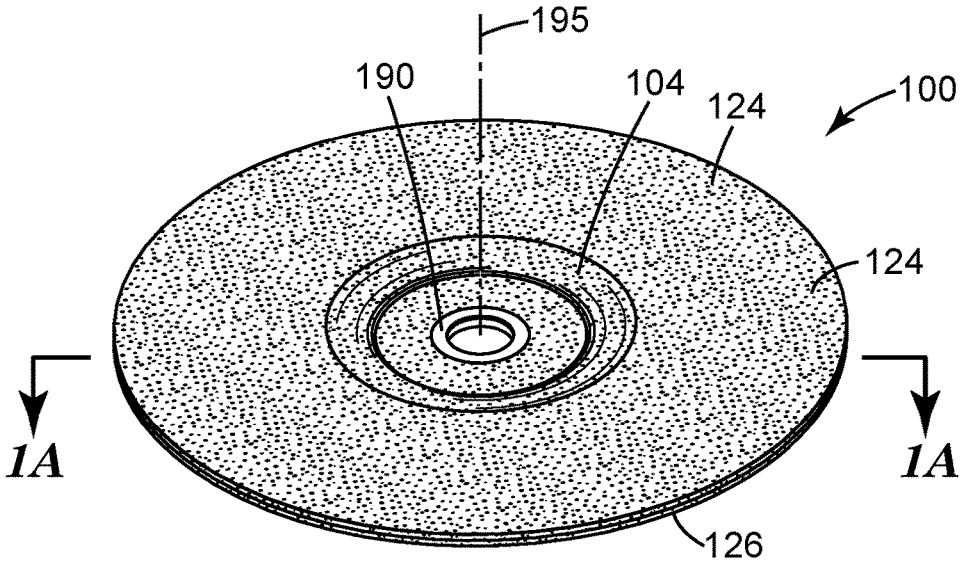
FIG. 1 is a schematic perspective view of an exemplary depressed-center bonded abrasive wheel 100 according to one embodiment of the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Figure 1A:
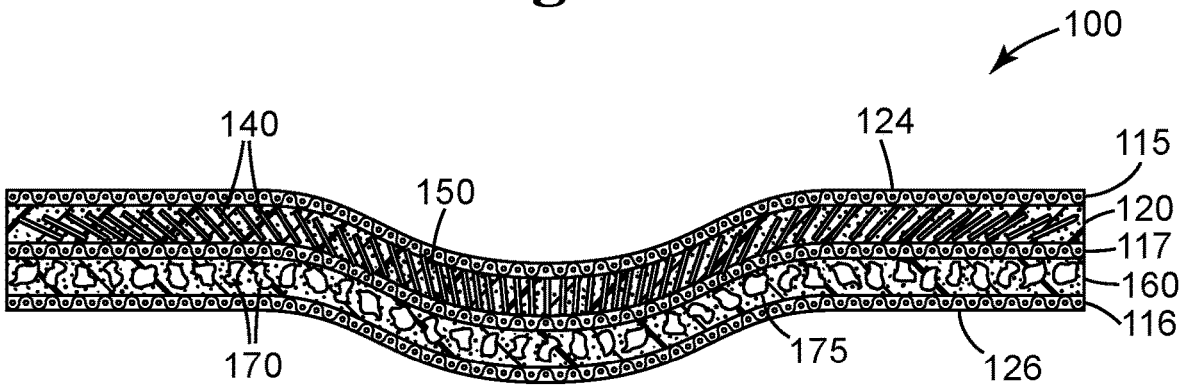
FIG. 1A is a schematic cross-sectional view of depressed-center abrasive wheel 100 shown in FIG. 1 taken along line 1A-1A.

Referring now to FIGS. 1 and 1A, exemplary depressed-center bonded abrasive wheel 100 with front surface 124 according to one embodiment of the present disclosure comprises primary abrasive layer 120. Primary abrasive layer 120 comprises magnetizable abrasive particles 140 (shown as rods) retained in a first organic binder 150. Optional secondary abrasive layer 160 defines a back surface 166 opposite front surface 124. Secondary abrasive layer 160 is bonded to primary abrasive layer 120. Optional secondary abrasive layer 160 comprises non-magnetizable abrasive particles 170 (e.g., crushed abrasive particles) retained in second organic binder 175. Second organic binder 175 may be the same as, or different than, first organic binder 150. In some embodiments, secondary abrasive layer 160 is not present.

Depressed-center bonded abrasive wheel 100 has depressed central portion 104 encircling central hub 190 that extends from front surface 124 to back surface 126, which can be used, for example, for attachment to a power driven tool (not shown). Primary abrasive layer 120 optionally further comprises primary reinforcing material 115 adjacent to front surface 124 primary abrasive layer 120. Optional secondary abrasive layer 160 optionally further comprises secondary reinforcing material 116 adjacent to back surface 166. Optional reinforcing material 117 is sandwiched between, and/or is disposed at the junction of, primary abrasive layer 120 and secondary abrasive layer 160. In some embodiments, the primary and secondary abrasive layers contact each other, while in other embodiments they a bonded to one another through one or more additional elements (e.g., a layer of a third organic binder optionally including reinforcing material 117).

In some embodiments, more than one (e.g., at least 2, at least 3, at least 4) abrasive layer containing magnetizable abrasive particles may be included in the bonded abrasive wheel. These abrasive layers may be prepared under the same or different magnetic field orientations.

Depressed-center bonded abrasive wheel 100 has rotational axis 195 around which the wheel rotates in use, and which is generally perpendicular to the disc of the depressed-center abrasive wheel. The magnetizable abrasive particles 140 adjacent to the central hub 190 are aligned at an average angle of less than 35 degrees (preferably less than 30 degrees more preferably less than 25 degrees, and even more preferably less than 20 degrees) with respect to the rotational axis 195. Magnetizable abrasive particles 140 adjacent to the outer circumference 168 of the bonded abrasive wheel are aligned at an average angle that is from 35 and 90 degrees (preferably from 40 to 90 degrees, more preferably 50 to 90 degrees, more preferably 60 to 90 degrees, more preferably 75 to 90 degrees), inclusive, with respect to the rotational axis 195.

Magnetizable abrasive particles useful in practice of the present disclosure each have a respective ceramic body having a magnetizable layer disposed on at least a portion thereof. Exemplary ceramic bodies include ceramic bodies (e.g., crushed ceramic abrasive particles) and ceramic platelets (e.g., triangular ceramic platelets). Useful ceramic bodies may have an average aspect ratio (i.e., length to thickness ratio) of at least 3, preferably at least 4, more preferably at least 5, and even more preferably at least 8. Useful ceramic platelets include triangular ceramic platelets (e.g., triangular prismatic ceramic platelets and truncated triangular ceramic platelets).

Figure 2:
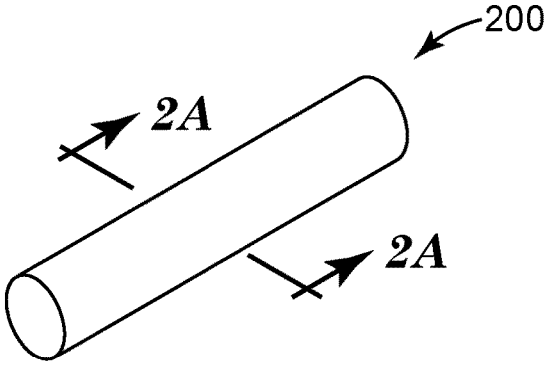
FIG. 2 is a schematic perspective view of exemplary magnetizable abrasive rod 200 useful for making a bonded abrasive wheel according to the present disclosure.
Figure 2A:
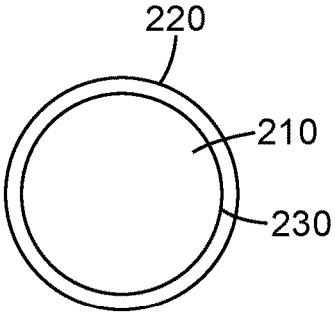
FIG. 2A is a schematic cross-sectional view of magnetizable abrasive rod 200 taken along line 2A-2A.

Referring now to FIGS. 2 and 2A, exemplary magnetizable abrasive particle 200 comprises cylindrically-shaped ceramic body 210 having magnetizable layer 220 disposed on its entire outer surface 230.

Figure 3:
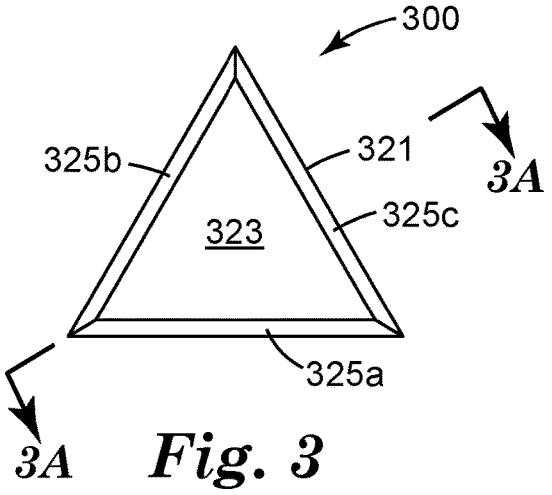
FIG. 3 is a schematic top view of exemplary magnetizable shaped abrasive platelet 300 useful for making a bonded abrasive wheel according to the present disclosure.
Figure 3A:
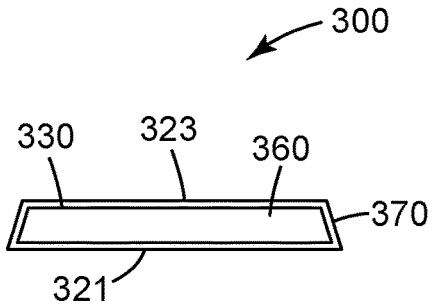
FIG. 3A is a schematic cross-sectional view of magnetizable shaped abrasive platelet 300 taken along line 3A-3A.

Likewise, in FIGS. 3 and 3A, exemplary magnetizable abrasive particle 300 comprises truncated triangular ceramic platelets 360 have magnetizable layer 370 disposed on its entire outer surface 330. Magnetizable abrasive particle 300 has opposed major surfaces 321, 323 connected to each other by sidewalls 325*a*, 325*b*, 325*c*.

In some embodiments, the magnetizable layer covers the ceramic body thereby enclosing it. The magnetizable layer may be a unitary magnetizable material (e.g., vapor-coated magnetizable metal), or it may comprise magnetizable particles in a binder. In some embodiments, the ceramic bodies are precisely-shaped.

Exemplary useful magnetizable materials for use in the magnetizable layer may comprise: iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (typically about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, alloys of neodymium, iron and boron (e.g., $Nd_2Fe_{14}B$), and alloys of samarium and cobalt (e.g., $SmCo_5$); MnSb; $MnOFe_2O_3$; $Y_3Fe_5O_{12}$; $CrO_2$; MnAs; ferrites such as ferrite, magnetite; zinc ferrite; nickel ferrite; cobalt ferrite, magnesium ferrite, barium ferrite, and strontium ferrite; yttrium iron garnet; and combinations of the foregoing. In some preferred embodiments, the magnetizable material comprises at least one metal selected from iron, nickel, and cobalt, an alloy of two or more such metals, or an alloy of at one such metal with at least one element selected from phosphorus and manganese. In some preferred embodiments, the magnetizable material is an alloy (e.g., Alnico alloy) containing 8 to 12 weight percent (wt. %) aluminum, 15 to 26 wt. % nickel, 5 to 24 wt. % cobalt, up to 6 wt. % copper, up to 1 wwt. % titanium, wherein the balance of material to add up to 100 wt. % is iron.

In some embodiments, the magnetizable layer may be deposited using a vapor deposition technique such as, for example, physical vapor deposition (PVD) including magnetron sputtering. PVD metallization of various particles is disclosed in, for example, U.S. Pat. No. 4,612,242 (Vesley)

and U.S. Pat. No. 7,727,931 (Brey et al.). Metallic magnetizable layers can typically be prepared in this general manner.

In some embodiments, the magnetizable layer includes a binder that retains magnetizable particles. The binder may be inorganic (e.g., vitreous) or organic resin-based, and is typically formed from a respective binder precursor.

Suitable binders for the magnetizable layer may be vitreous or organic, for example, as described for the binder 130 hereinbelow. Preferably, the binder of the magnetizable layer is organic, as high temperature curing conditions for inorganic binder precursor may tend to degrade the magnetizable properties of the magnetizable particles.

Organic binders (e.g., crosslinked organic polymers) are generally prepared by curing (i.e., crosslinking) a resinous organic binder precursor. Examples of suitable organic binder precursors include thermally-curable resins and radiation-curable resins, which may be cured, for example, thermally and/or by exposure to radiation. Exemplary organic binder precursors include glues, phenolic resins, aminoplast resins, urea-formaldehyde resins, melamine-formaldehyde resins, urethane resins, acrylic resins (e.g., aminoplast resins having pendant α,β-unsaturated groups, acrylated urethanes, acrylated epoxy resins, acrylated isocyanurates), acrylic monomer/oligomer resins, epoxy resins (including bismaleimide and fluorene-modified epoxy resins), isocyanurate resins, an combinations thereof. Curatives such as thermal initiators, catalysts, photoinitiators, hardeners, and the like may be added to the organic binder precursor, typically selected and in an effective amount according to the resin system chosen. Exemplary organic binders can be found in U.S. Pat. No. 5,766,277 (DeVoe et al.). Examples of vitreous binders are set forth hereinbelow in the discussion of bonded abrasive wheel manufacture. The ceramic bodies may comprise any ceramic material (preferably a ceramic abrasive material), for example, selected from among the ceramic (i.e., not including diamond) materials listed below, and combinations thereof. The magnetizable layer is preferably essentially free of (i.e., containing less than 5 weight percent of, preferably containing less than 1 weight percent of) ceramic abrasive materials used in the ceramic body.

Useful ceramic materials that can be used in ceramic bodies include, for example, alumina (e.g., fused aluminum oxide, heat treated aluminum oxide, white fused aluminum oxide, ceramic aluminum oxide materials such as those commercially available as 3M CERAMIC ABRASIVE GRAIN from 3M Company of St. Paul, Minn.), black silicon carbide, green silicon carbide, titanium diboride, boron carbide, tungsten carbide, titanium carbide, cubic boron nitride, garnet, fused alumina zirconia, sol-gel derived ceramics (e.g., alumina ceramics doped with chromia, ceria, zirconia, titania, silica, and/or tin oxide), silica (e.g., quartz, glass beads, glass bubbles and glass fibers), feldspar, or flint. Examples of sol-gel derived crushed ceramic particles can be found in U.S. Pat. No. 4,314,827 (Leitheiser et al.), U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.).

Preferably, the ceramic material in the ceramic bodies has a Mohs hardness of at least 6, preferably at least 7, and more preferably at least 8, although this is not a requirement.

Further details concerning methods of making sol-gel-derived ceramic particles suitable or use as ceramic bodies can be found in, for example, U.S. Pat. No. 4,314,827 (Leitheiser), U.S. Pat. No. 5,152,917 (Pieper et al.), U.S. Pat. No. 5,213,591 (Celikkaya et al.), U.S. Pat. No. 5,435,816 (Spurgeon et al.), U.S. Pat. No. 5,672,097 (Hoopman et al.), U.S. Pat. No. 5,946,991 (Hoopman et al.), U.S. Pat. No. 5,975,987 (Hoopman et al.), and U.S. Pat. No. 6,129,540 (Hoopman et al.), and in U.S. Publ. Pat. Appln. Nos. 2009/0165394 A1 (Culler et al.) and 2009/0169816 A1 (Erickson et al.).

The ceramic body may be shaped (e.g., precisely-shaped) or randomly shaped (e.g., crushed). Shaped abrasive particles and precisely-shaped ceramic bodies may be prepared by a molding process using sol-gel technology as described in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina particles that have been formed in a specific shape, then crushed to form shards that retain a portion of their original shape features. In some embodiments, the ceramic bodies are precisely-shaped (i.e., the ceramic bodies have shapes that are at least partially determined by the shapes of cavities in a production tool used to make them).

Exemplary shapes of ceramic bodies include cylindrical, vermiform, hourglass-shaped, bow tie shaped, truncated pyramids (e.g., 3-, 4-, 5-, or 6-sided truncated pyramids), truncated cones, and prisms (e.g., 3-, 4-, 5-, or 6-sided prisms). One exemplary a ceramic body 300 shaped as a truncated triangular pyramid is shown in FIG. 3.

Details concerning such shaped ceramic bodies and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

The magnetizable layer may be disposed on the ceramic bodies by any suitable method such as, for example, dip coating, spraying, painting, vapor coating, and powder coating. Individual magnetizable abrasive particles may have magnetizable layers with different degrees of coverage and/or locations of coverage.

The magnetizable particles may have any size, but are preferably much smaller than the ceramic bodies as judged by average particle diameter, preferably 4 to 2000 times smaller, more preferably 100 to 2000 times smaller, and even more preferably 500 to 2000 times smaller, although other sizes may also be used. In this embodiment, the magnetizable particles may have a Mohs hardness of 6 or less (e.g., 5 or less, or 4 or less), although this is not a requirement.

In embodiments adapted for fine finishing, the magnetizable abrasive particles preferably have an average particle length of less than or equal to 1500 microns, although average particle sizes outside of this range may also be used. For repair and finishing applications, useful abrasive particle sizes for magnetizable abrasive particles, and optional non-magnetizable abrasive particles/rods if present, typically range from an average length in a range of from at least 1 micron, at least 50 microns, or at least 100 microns up to and including 500, 1000, or even as much as 5 millimeters, or even 10 millimeters, although other lengths may also be used.

The primary abrasive layer includes magnetizable abrasive particles retained in a first binder. The secondary abrasive layer includes non-magnetizable abrasive particles retained in a second binder, which may be the same as or different from the first binder. Useful binders may be and organic binder (which may be thermoplastic and/or cross-linked) or an inorganic binder (e.g., vitreous binder).

The primary abrasive layer is generally provided by dispersing the magnetizable abrasive particles in a suitable binder precursor, optionally in the presence of an appropriate curative (e.g., photoinitiator, thermal curative, and/or catalyst). Simply mixing techniques are generally sufficient to mix the components. Subsequently, the mixture is molded and cured as discussed hereinbelow.

The secondary abrasive layer is generally accomplished by dispersing non-magnetizable abrasive particles in a suitable binder precursor, optionally in the presence of an appropriate curative (e.g., photoinitiator, thermal curative, and/or catalyst). Simply mixing techniques are generally sufficient to mix the components. Subsequently, the mixture is molded and cured as discussed hereinbelow.

The first organic binder and the second organic binder may be the same or different (e.g., chemically different). For example, the first organic binder may be a first phenolic binder and the second organic binder may be a second phenolic binder that is chemically different than the first phenolic binder.

Examples of suitable organic binders that are useful in abrasive composites include phenolics, aminoplasts, urethanes, epoxies, acrylics, cyanates, isocyanurates, glue, and combinations thereof.

Typically, organic binders are prepared by crosslinking (e.g., at least partially curing and/or polymerizing) an organic binder precursor. Suitable organic binder precursors for the shaped abrasive composites may be the same as, or different from, organic binder precursors that can be used in the magnetizable layer described hereinabove. During the manufacture of the structured abrasive article, the organic binder precursor may be exposed to an energy source which aids in the initiation of polymerization (typically including crosslinking) of the organic binder precursor. Examples of energy sources include thermal energy and radiation energy which includes electron beam, ultraviolet light, and visible light. In the case of an electron beam energy source, curative is not necessarily required because the electron beam itself generates free radicals.

After this polymerization process, the organic binder precursor is converted into a solidified organic binder. Alternatively, for a thermoplastic organic binder precursor, during the manufacture of the abrasive article the thermoplastic organic binder precursor is cooled to a degree that results in solidification of the organic binder precursor.

Organic binders are preferably included in both of the first and secondary abrasive layers; for example, in amounts of from 5 to 50 percent, more preferably 10 to 40, and even more preferably 15 to 40 percent by weight, based on the total weight of the respective first and secondary abrasive layers, however other amounts may also be used. The organic binder is typically formed by at least partially curing a corresponding organic binder precursor.

There are two main classes of polymerizable resins that may preferably be included in the organic binder precursor, condensation polymerizable resins and addition polymerizable resins. Addition polymerizable resins are advantageous because they are readily cured by exposure to radiation energy. Addition polymerized resins can polymerize, for example, through a cationic mechanism or a free-radical mechanism. Depending upon the energy source that is utilized and the binder precursor chemistry, a curing agent, initiator, or catalyst may be useful to help initiate the polymerization.

Examples of typical binder precursors include phenolic resins, urea-formaldehyde resins, aminoplast resins, urethane resins, melamine formaldehyde resins, cyanate resins, isocyanurate resins, (meth)acrylate resins (e.g., (meth)acrylated urethanes, (meth)acrylated epoxies, ethylenically-unsaturated free-radically polymerizable compounds, aminoplast derivatives having pendant alpha, beta-unsaturated carbonyl groups, isocyanurate derivatives having at least one pendant acrylate group, and isocyanate derivatives having at least one pendant acrylate group) vinyl ethers, epoxy resins, and mixtures and combinations thereof. As used herein, the term "(meth)acryl" encompasses acryl and methacryl.

Phenolic resin is an exemplary useful organic binder precursor, and may be used in powder form and/or liquid state. Organic binder precursors that can be cured (i.e., polymerized and/or crosslinked) to form useful organic binders include, for example, one or more phenolic resins (including novolac and/or resole phenolic resins) one or more epoxy resins, one or more urea-formaldehyde binders, one or more polyester resins, one or more polyimide resins, one or more rubbers, one or more polybenzimidazole resins, one or more shellacs, one or more acrylic monomers and/or oligomers, and combinations thereof. The organic binder precursor(s) may be combined with additional components such as, for example, curatives, hardeners, catalysts, initiators, colorants, antistatic agents, grinding aids, and lubricants. Conditions for curing each of the foregoing are well-known to those of ordinary skill in the art.

Useful phenolic resins include novolac and resole phenolic resins. Novolac phenolic resins are characterized by being acid-catalyzed and having a ratio of formaldehyde to phenol of less than one, typically between 0.5:1 and 0.8:1. Resole phenolic resins are characterized by being alkaline catalyzed and having a ratio of formaldehyde to phenol of greater than or equal to one, typically from 1:1 to 3:1. Novolac and resole phenolic resins may be chemically modified (e.g., by reaction with epoxy compounds), or they may be unmodified. Exemplary acidic catalysts suitable for curing phenolic resins include sulfuric, hydrochloric, phosphoric, oxalic, and p-toluenesulfonic acids. Alkaline catalysts suitable for curing phenolic resins include sodium hydroxide, barium hydroxide, potassium hydroxide, calcium hydroxide, organic amines, or sodium carbonate.

Phenolic resins are well-known and readily available from commercial sources. Examples of commercially available novolac resins include DUREZ 1364, a two-step, powdered phenolic resin (marketed by Durez Corporation, Addison, Tex., under the trade designation VARCUM (e.g., 29302), or HEXION AD5534 RESIN (marketed by Hexion Specialty Chemicals, Inc., Louisville, Ky.). Examples of commercially available resole phenolic resins useful in practice of the present disclosure include those marketed by Durez Corporation under the trade designation VARCUM (e.g., 29217, 29306, 29318, 29338, 29353); those marketed by Ashland Chemical Co., Bartow, Fla. under the trade designation AEROFENE (e.g., AEROFENE 295); and those marketed by Kangnam Chemical Company Ltd., Seoul, South Korea under the trade designation "PHENOLITE" (e.g., PHENOLITE TD-2207). Curing temperatures of thermally curable organic binder precursors will vary with the material chosen and wheel design. Selection of suitable conditions is within the capability of one of ordinary skill in the art. Exemplary conditions for a phenolic binder may include an applied pressure of about 20 tons per 4 inches diameter (224 $kg/cm^2$) at room temperature followed by heating at temperatures up to about 185° C. for sufficient time to cure the organic binder material precursor.

(Meth)acrylated urethanes include di(meth)acrylate esters of hydroxyl-terminated NCO extended polyesters or polyethers. Examples of commercially available acrylated urethanes include those available as CMD 6600, CMD 8400, and CMD 8805 from Cytec Industries, West Paterson, N.J.

(Meth)acrylated epoxies include di(meth)acrylate esters of epoxy resins such as the diacrylate esters of bisphenol A epoxy resin. Examples of commercially available acrylated epoxies include those available as CMD 3500, CMD 3600, and CMD 3700 from Cytec Industries.

Ethylenically-unsaturated free-radically polymerizable compounds include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically-unsaturated free-radically polymerizable compounds typically have a molecular weight of less than about 4,000 g/mole and are typically esters made from the reaction of compounds containing a single aliphatic hydroxyl group or multiple aliphatic hydroxyl groups and unsaturated carboxylic acids, such as acrylic acid, methacrylic acid, itaconic acid, crotonic acid, isocrotonic acid, maleic acid, and the like. Representative examples of ethylenically-unsaturated free-radically polymerizable compounds include methyl methacrylate, ethyl methacrylate, styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyl-oxyethyl) isocyanurate, 1,3,5-tris(2-methyacryloxyethyl)-s-triazine, acrylamide, N-methylacrylamide, N,N-dimethylacrylamide, N-vinylpyrrolidone, and N-vinylpiperidone.

Useful aminoplast resins have at least one pendant α,β-unsaturated carbonyl group per molecule or oligomer. These unsaturated carbonyl groups can be acrylate, methacrylate, or acrylamide type groups. Examples of such materials include N-(hydroxymethyl)acrylamide, N,N'-oxydimethylenebisacrylamide, ortho- and para-acrylamidomethylated phenol, acrylamidomethylated phenolic novolac, and combinations thereof. These materials are further described in U.S. Pat. Nos. 4,903,440 and 5,236,472 (both to Kirk et al.).

Isocyanurate derivatives having at least one pendant acrylate group and isocyanate derivatives having at least one pendant acrylate group are further described in U.S. Pat. No. 4,652,274 (Boettcher et al.). An example of one isocyanurate material is the triacrylate of tris(hydroxyethyl) isocyanurate.

Epoxy resins have one or more epoxy groups that may be polymerized by ring opening of the epoxy group(s). Such epoxy resins include monomeric epoxy resins and oligomeric epoxy resins. Examples of useful epoxy resins include 2,2-bis[4-(2,3-epoxypropoxy)-phenyl propane] (diglycidyl ether of bisphenol) and materials available as EPON 828, EPON 1004, and EPON 1001F from Momentive Specialty Chemicals, Columbus, Ohio; and DER-331, DER-332, and DER-334 from Dow Chemical Co., Midland, Mich. Other suitable epoxy resins include glycidyl ethers of phenol formaldehyde novolac commercially available as DEN-431 and DEN-428 from Dow Chemical Co.

Epoxy resins can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid. Other curing agents (e.g., amine hardeners and guanidines) for epoxy resins and phenolic resins may also be used.

Other cationic curing agents include a salt having an organometallic complex cation and a halogen containing complex anion of a metal or metalloid which are further described in U.S. Pat. No. 4,751,138 (Tumey et al.). Another example is an organometallic salt and an onium salt is described in U.S. Pat. No. 4,985,340 (Palazzotto et al.); U.S. Pat. No. 5,086,086 (Brown-Wensley et al.); and U.S. Pat. No. 5,376,428 (Palazzotto et al.). Still other cationic curing agents include an ionic salt of an organometallic complex in which the metal is selected from the elements of Periodic Group IVB, VB, VIB, VIIB and VIIIB which is described in U.S. Pat. No. 5,385,954 (Palazzotto et al.).

Examples of free radical thermal initiators include peroxides, e.g., benzoyl peroxide and azo compounds.

Compounds that generate a free radical source if exposed to actinic electromagnetic radiation are generally termed photoinitiators. Examples of photoinitiators include benzoin and its derivatives such as α-methylbenzoin; α-phenylbenzoin; α-allylbenzoin; α-benzylbenzoin; benzoin ethers such as benzil dimethyl ketal (e.g., as commercially available as IRGACURE 651 from Ciba Specialty Chemicals, Tarrytown, N.Y.), benzoin methyl ether, benzoin ethyl ether, benzoin n-butyl ether; acetophenone and its derivatives such as 2-hydroxy-2-methyl-1-phenyl-1-propanone (e.g., as DAROCUR 1173 from Ciba Specialty Chemicals) and 1-hydroxycyclohexyl phenyl ketone (e.g., as IRGACURE 184 from Ciba Specialty Chemicals); 2-methyl-1-[4-(methylthio)phenyl]-2-(4-morpholinyl)-1-propanone (e.g., as IRGACURE 907 from Ciba Specialty Chemicals; 2-benzyl-2-(dimethylamino)-1-[4-(4-morpholinyl)phenyl]-1-butanone (e.g., as IRGACURE 369 from Ciba Specialty Chemicals). Other useful photoinitiators include, for example, pivaloin ethyl ether, anisoin ethyl ether, anthraquinones (e.g., anthraquinone, 2-ethylanthraquinone, 1-chloroanthraquinone, 1,4-dimethylanthraquinone, 1-methoxyanthraquinone, or benzanthraquinone), halomethyltriazines, benzophenone and its derivatives, iodonium salts and sulfonium salts, titanium complexes such as bis($\eta_5$-2,4-cyclopentadien-1-yl)-bis[2,6-difluoro-3-(1H-pyrrol-1-yl)phenyl]titanium (e.g., as CGI 784DC from Ciba Specialty Chemicals); halonitrobenzenes (e.g., 4-bromomethylnitrobenzene), mono- and bis-acylphosphines (e.g., as IRGACURE 1700, IRGACURE 1800, IRGACURE 1850, and DAROCUR 4265 all from Ciba Specialty Chemicals). Combinations of photoinitiators may be used. One or more spectral sensitizers (e.g., dyes) may be used in conjunction with the photoinitiator(s), for example, in order to increase sensitivity of the photoinitiator to a specific source of actinic radiation.

To promote an association bridge between the abovementioned binder and the abrasive particles, a silane coupling agent may be included in the slurry of abrasive particles and organic binder precursor; typically in an amount of from about 0.01 to 5 percent by weight, more typically in an amount of from about 0.01 to 3 percent by weight, more typically in an amount of from about 0.01 to 1 percent by weight, although other amounts may also be used, for example depending on the size of the abrasive particles. Suitable silane coupling agents include, for example, methacryloxypropylsilane, vinyltriethoxysilane, vinyltris(2-methoxyethoxy)silane, 3,4-epoxycyclohexylmethyltrimethoxysilane, γ-glycidoxypropyltrimethoxysilane, and γ-mercaptopropyltrimethoxysilane (e.g., as available under the respective trade designations A-174, A-151, A-172, A-186, A-187, and A-189 from Witco Corp. of Greenwich, Conn.), allyltriethoxysilane, diallyldichlorosilane, divinyldiethoxysilane, and meta, para-styrylethyltrimethoxysilane (e.g., as commercially available under the respective trade designations A0564, D4050, D6205, and S 1588 from United Chemical Industries, Bristol, Pa.), dimethyldiethoxysilane, dihydroxydiphenylsilane, triethoxysilane, trimethoxysilane, triethoxysilanol, 3-(2-aminoethylamino) propyltrimethoxysilane, methyltrimethoxysilane, vinyltriacetoxysilane, methyltriethoxysilane, tetraethyl orthosilicate, tetramethyl orthosilicate, ethyltriethoxysilane, amyltriethoxysilane, ethyltrichlorosilane, amyltrichlorosilane, phenyltrichlorosilane, phenyltriethoxysilane, methyltrichlorosilane, methyldichlorosilane, dimethyldichlorosilane, dimethyldiethoxysilane, and mixtures thereof.

Vitreous binders may be produced from a precursor composition comprising a mixture or combination of one or more raw materials that when heated to a high temperature melt and/or fuse to form an integral vitreous binder matrix. The vitreous binder may be formed, for example, from frit. A frit is a composition that has been pre-fired before its use as a vitreous binder precursor composition for forming the vitreous binder of the magnetizable agglomerate abrasive particle.

Vitreous binders may be produced from a precursor composition comprising a mixture or combination of one or more raw materials that when heated to a high temperature melt and/or fuse to form an integral vitreous binder matrix. The vitreous binder may be formed, for example, from frit. A frit is a composition that has been pre-fired before its use as a vitreous binder precursor composition for forming the vitreous binder of the magnetizable agglomerate abrasive particle.

As used herein, the term "frit" is a generic term for a material that is formed by thoroughly blending a mixture comprising one or more frit forming components, followed by heating (also referred to as pre-firing) the mixture to a temperature at least high enough to melt it; cooling the resulting glass, and crushing it. The crushed material can then be screened to a very fine powder.

Examples of suitable glasses for the vitreous binder and the frit for making it include silica glass, silicate glass, borosilicate glass, and combinations thereof. A silica glass is typically composed of 100 percent by weight of silica. In some embodiments, the vitreous binder is a glass that include metal oxides or oxides of metalloids, for example, aluminum oxide, silicon oxide, boron oxide, magnesium oxide, sodium oxide, manganese oxide, zinc oxide, calcium oxide, barium oxide, lithium oxide, potassium oxide, titanium oxide, metal oxides that can be characterized as pigments (e.g., cobalt oxide, chromium oxide, and iron oxide), and mixtures thereof.

Examples of suitable ranges for the vitreous binder and/or vitreous binder precursor, include, based on the total weight of the vitreous binder and/or vitreous binder precursor: 25 to 90% by weight, preferably 35 to 85% by weight of $SiO_2$; 0 to 40% by weight, preferably 0 to 30% by weight, of $B_2O_3$; 0 to 40% by weight, preferably 5 to 30% by weight, of $Al_2O_3$; 0 to 5% by weight, preferably 0 to 3% by weight, of $Fe_2O_3$; 0 to 5% by weight, preferably 0 to 3% by weight, of $TiO_2$; 0 to 20% by weight, preferably 0 to 10% by weight, of CaO; 0 to 20% by weight, preferably 1 to 10% by weight, of MgO; 0 to 20% by weight, preferably 0 to 10% by weight, of $K_2O$; 0 to 25% by weight, preferably 0 to 15% by weight, of $Na_2O$; 0 to 20% by weight, preferably 0 to 12% by weight, of $Li_2O$; 0 to 10% by weight, preferably 0 to 3% by weight, of ZnO; 0 to 10% by weight, preferably 0 to 3% by weight, of BaO; and 0 to 5% by weight, preferably 0 to 3% by weight, of metallic oxides (e.g., CoO, $Cr_2O_3$ or other pigments).

An example of a suitable silicate glass composition comprises about 70 to about 80 percent by weight of silica, about 10 to about 20 percent sodium oxide, about 5 to about 10 percent calcium oxide, about 0.5 to about 1 percent aluminum oxide, about 2 to about 5 percent magnesium oxide, and about 0.5 to about 1 percent potassium oxide, based on the total weight of the glass frit. Another example of a suitable silicate glass composition includes about 73 percent by weight of silica, about 16 percent by weight of sodium oxide, about 5 percent by weight of calcium oxide, about 1 percent by weight of aluminum oxide, about 4 percent by weight of magnesium oxide, and about 1 percent by weight of potassium oxide, based on the total weight of the glass frit. In some embodiments, the glass matrix comprises an alumina-borosilicate glass comprising $SiO_2$, $B_2O_3$, and $Al_2O_3$. An example of a suitable borosilicate glass composition comprises about 50 to about 80 percent by weight of silica, about 10 to about 30 percent by weight of boron oxide, about 1 to about 2 percent by weight of aluminum oxide, about 0 to about 10 percent by weight of magnesium oxide, about 0 to about 3 percent by weight of zinc oxide, about 0 to about 2 percent by weight of calcium oxide, about 1 to about 5 percent by weight of sodium oxide, about 0 to about 2 percent by weight of potassium oxide, and about 0 to about 2 percent by weight of lithium oxide, based on the total weight of the glass frit. Another example of a suitable borosilicate glass composition includes about 52 percent by weight of silica, about 27 percent by weight of boron oxide, about 9 percent by weight of aluminum oxide, about 8 percent by weight of magnesium oxide, about 2 percent by weight of zinc oxide, about 1 percent by weight of calcium oxide, about 1 percent by weight of sodium oxide, about 1 percent by weight of potassium oxide, and about 1 percent by weight of lithium oxide, based on the total weight of the glass frit. Other examples suitable borosilicate glass composition include, based upon weight, 47.61% $SiO_2$, 16.65% $Al_2O_3$, 0.38% $Fe_2O_3$, 0.35% $TiO_2$, 1.58% CaO, 0.10% MgO, 9.63% $Na_2O$, 2.86% $K_2O$, 1.77% $Li_2O$, 19.03% $B_2O_3$, 0.02% $MnO_2$, and 0.22% $P_2O_5$; and 63% $SiO_2$, 12% $Al_2O_3$, 1.2% CaO, 6.3% $Na_2O$, 7.5% $K_2O$, and 10% $B_2O_3$. In some embodiments, a useful alumina-borosilicate glass composition comprises, by weight, about 18% $B_2O_3$, 8.5% $Al_2O_3$, 2.8% BaO, 1.1% CaO, 2.1% $Na_2O$, 1.0% $Li_2O$, with the balance being $SiO_2$. Such an alumina-borosilicate glass, having a particle size of less than about 45 mm, is commercially available from Specialty Glass Incorporated, Oldsmar, Fla.

Glass frit for making glass ceramics suitable for use as the vitreous binder matrix may be selected from the group consisting of magnesium aluminosilicate, lithium aluminosilicate, zinc aluminosilicate, calcium aluminosilicate, and combinations thereof. Known crystalline ceramic phases that can form glasses within the above listed systems include: cordierite ($2MgO.2Al_2O_3.5SiO_2$), gehlenite ($2CaO.Al_2O_3.SiO_2$), anorthite ($2CaO.Al_2O_3.2SiO_2$), hardystonite ($2CaO.ZnO.2SiO_2$), akeranite ($2CaO.MgO.2SiO_2$), spodumene ($2Li_2O.Al_2O_3.4SiO_2$), willemite ($2ZnO.SiO_2$), and gahnite ($ZnO.Al_2O_3$). Glass frit for making glass-ceramic may comprise nucleating agents. Nucleating agents are known to facilitate the formation of crystalline ceramic phases in glass-ceramics. As a result of specific processing techniques, glassy materials do not have the long range order that crystalline ceramics have. Glass-ceramics are the result of controlled heat-treatment to produce, in some cases, over 90% crystalline phase or phases with the remaining non-crystalline phase filling the grain boundaries. Glass ceramics combine the advantage of both ceramics and glasses and offer durable mechanical and physical properties.

Frit useful for forming vitreous binder may also contain frit binders (e.g., feldspar, borax, quartz, soda ash, zinc oxide, whiting, antimony trioxide, titanium dioxide, sodium silicofluoride, flint, cryolite, boric acid, and combinations thereof) and other minerals (e.g., clay, kaolin, wollastonite, limestone, dolomite, chalk, and combinations thereof).

Vitreous binder in the magnetizable abrasive particles may be selected, for example, based on a desired coefficient of thermal expansion (CTE). Generally, it is useful for the vitreous binder and abrasive particles to have similar CTEs, for example, ±100%, 50%, 40%, 25%, or 20% of each other. The CTE of fused alumina is typically about $8\times10^{-6}$/Kelvin (K). A vitreous binder may be selected to have a CTE in a range from $4\times10^{-6}$/K to $16\times10^{-6}$/K. An example of a glass frit for making a suitable vitreous binder is commercially available, for example, as F245 from Fusion Ceramics, Carrollton, Ohio.

During manufacture, the vitreous binder precursor, in a powder form, may be mixed with a temporary binder, typically an organic binder (e.g., starch, sucrose, mannitol), which burns out during firing of the vitreous binder precursor.

Organic and vitreous binder precursors may optionally contain additives such as, for example, colorants, grinding aids, fillers, pore formers, wetting agents, dispersing agents, light stabilizers, and antioxidants.

Grinding aids encompass a wide variety of different materials including both organic and inorganic compounds. A sampling of chemical compounds effective as grinding aids includes waxes, organic halide compounds, halide salts, metals and metal alloys. Specific waxes effective as a grinding aid include specifically, but not exclusively, the halogenated waxes tetrachloronaphthalene and pentachloronaphthalene. Other effective grinding aids include halogenated thermoplastics, sulfonated thermoplastics, waxes, halogenated waxes, sulfonated waxes, and mixtures thereof. Other organic materials effective as a grinding aid include specifically, but not exclusively, polyvinylchloride and polyvinylidene chloride. Examples of halide salts generally effective as a grinding aid include sodium chloride, potassium cryolite, sodium cryolite, ammonium cryolite, potassium tetrafluoroborate, sodium tetrafluoroborate, silicon fluorides, potassium chloride, and magnesium chloride. Halide salts employed as a grinding aid typically have an average particle size of less than 100 microns, with particles of less than 25 microns being preferred. Examples of metals generally effective as a grinding aid include antimony, bismuth, cadmium, cobalt, iron, lead, tin, and titanium. Other commonly used grinding aids include sulfur, organic sulfur compounds, graphite, and metallic sulfides. Combinations of these grinding aids can also be employed.

Bonded abrasive wheels according to the present disclosure may further comprise non-magnetizable abrasive particles (e.g., which may be crushed or shaped) in either of the primary abrasive layer and the secondary abrasive layer. These non-magnetizable abrasive particles may be sized according to an abrasives industry specified nominal grade or combination of nominal grades.

Bonded abrasive wheels according to the present disclosure can be made by a molding process. During molding, first and second organic binder precursors, which may be liquid or powdered, or a combination of liquid and powder, is mixed with abrasive particles. In some embodiments, a liquid medium (either curable organic resin or a solvent) is first applied to the abrasive particles to wet their outer surface, and then the wetted abrasive particles are mixed with a powdered organic binder precursor. Bonded abrasive wheels according to the present disclosure may be made, for example, by compression molding, injection molding, and/or transfer molding.

The bonded abrasive wheels, optionally including one or more reinforcement materials, may be molded either by hot or cold pressing in any suitable manner well known to those skilled in the art.

For example, in one exemplary process, a mold having a central-aperture-forming arbor surrounded by a circular cavity in which the center is depressed may be used to mold depressed-center or raised-hub wheels. Abrasive wheels may be molded by first placing a disc of reinforcing material having a center hole around the arbor and in contact with the bottom of the mold. Then, spreading a uniform layer of a second curable mixture comprising the first crushed abrasive particles, and the second organic binder precursor on top of the disc of reinforcing material. Next, another disc of reinforcing material with a center hole positioned around the arbor is placed onto the layer of the second curable mixture, followed by spreading a uniform layer of the first curable mixture comprising shaped ceramic abrasive particles, optional non-magnetizable abrasive particles (e.g., non-magnetizable crushed abrasive particles) and the first binder precursor thereon. Lastly, a hub reinforcing disc with a center hole therein is placed around the arbor and onto the layer of the first curable mixture, and a top mold plate of the desired shape to either produce the depressed-center or the straight center hub portion of the wheels, is placed on top of the layers to form a mold assembly. The mold assembly is then placed between the platens of either a conventional cold or hot press. Then the press is actuated to force the mold plate downwardly and compress the discs and abrasive mixtures together, at a pressure of from 1 to 4 tons per square inch, into a self-supporting structure of predetermined thickness, diameter and density. After molding the wheel is stripped from the mold and placed in an oven heated (e.g., to a temperature of approximately 175° C. to 200° C. for approximately 36 hours) to cure the curable mixtures and convert the organic binder precursors into useful organic binders.

In some embodiments, the primary abrasive layer includes from about 10 to about 90 percent by weight of the magnetizable abrasive particles; preferably from about 30 to about 80 percent by weight, and more preferably from about 40 to about 80 percent by weight, based on the total weight of the binder material and magnetizable abrasive particles.

In some embodiments, the secondary abrasive layer includes from about 10 to about 90 percent by weight of non-magnetizable abrasive particles; preferably from about 30 to about 80 percent by weight, and more preferably from about 40 to about 80 percent by weight, based on the total weight of the binder material and non-magnetizable abrasive particles. Typically, the secondary abrasive layer comprises less than 10 percent by volume, less than 5 percent by volume, or even less than one percent by volume, of the magnetizable abrasive particles. In some embodiments, the secondary abrasive layer is free of the magnetizable abrasive particles.

Useful non-magnetizable abrasive particles include, for example, crushed particles of fused aluminum oxide, heat treated aluminum oxide, white fused aluminum oxide, ceramic aluminum oxide materials such as those commercially available under the trade designation 3M CERAMIC ABRASIVE GRAIN from 3M Company of St. Paul, Minn., black silicon carbide, green silicon carbide, titanium diboride, boron carbide, tungsten carbide, titanium carbide, cubic boron nitride, garnet, fused alumina zirconia, sol-gel derived abrasive particles, iron oxide, chromia, ceria, zirconia, titania, silicates, tin oxide, silica (such as quartz, glass beads, glass bubbles and glass fibers) silicates (such as talc, clays (e.g., montmorillonite), feldspar, mica, calcium silicate, calcium metasilicate, sodium aluminosilicate, sodium silicate), flint, and emery. Examples of sol-gel derived abrasive particles can be found in U.S. Pat. No. 4,314,827 (Leitheiser et al.), U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.).

Abrasive particles used in the bonded abrasive wheels of the present disclosure, whether magnetizable or non-magnetizable, may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). Such industry accepted grading standards include, for example: ANSI 4, ANSI 6, ANSI 8, ANSI 16, ANSI 24, ANSI 30, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600; FEPA P8, FEPA P12, FEPA P16, FEPA P24, FEPA P30, FEPA P36, FEPA P40, FEPA P50, FEPA P60, FEPA P80, FEPA P100, FEPA P120, FEPA P150, FEPA P180, FEPA P220, FEPA P320, FEPA P400, FEPA P500, FEPA P600, FEPA P800, FEPA P1000, FEPA P1200; FEPA F8, FEPA F12, FEPA F16, and FEPA F24; and JIS 8, JIS 12, JIS 16, JIS 24, JIS 36, JIS 46, JIS 54, JIS 60, JIS 80, JIS 100, JIS 150, JIS 180, JIS 220, JIS 240, JIS 280, JIS 320, JIS 360, JIS 400, JIS 400, JIS 600, JIS 800, JIS 1000, JIS 1500, JIS 2500, JIS 4000, JIS 6000, JIS 8000, and JIS 10,000. More typically, the crushed aluminum oxide particles and the non-seeded sol-gel derived alumina-based abrasive particles are independently sized to ANSI 60 and 80, or FEPA F36, F46, F54 and F60 or FEPA P60 and P80 grading standards.

Alternatively, the abrasive particles (magnetizable or non-magnetizable) can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the shaped ceramic abrasive particles pass through a test sieve meeting ASTM E-11 specifications for the number 18 sieve and are retained on a test sieve meeting ASTM E-11 specifications for the number 20 sieve. In one embodiment, the shaped ceramic abrasive particles have a particle size such that most of the particles pass through an 18 mesh test sieve and can be retained on a 20, 25, 30, 35, 40, 45, or 50 mesh test sieve. In various embodiments, the shaped ceramic abrasive particles can have a nominal screened grade comprising: −18+20, −20/+25, −25+30, −30+35, −35+40, 5−40+45, −45+50, −50+60, −60+70, −701+80, −80+100, −100+120, −120+140, −140+170, −170+200, −200+230, −230+270, −270+325, −325+400, −400+450, −450+500, or −500+635. Alternatively, a custom mesh size could be used such as −90+100.

Abrasive particles (i.e., magnetizable or non-magnetizable abrasive particles) may be uniformly or non-uniformly distributed throughout the primary abrasive layer. Non-magnetizable abrasive particles may be uniformly or non-uniformly distributed throughout the secondary abrasive layer of the bonded abrasive wheel. Abrasive particles may be concentrated toward the middle (e.g., located away from outer surfaces of), or only adjacent the outer edge, i.e., the periphery, of the bonded abrasive wheel. A center portion may contain a lesser amount of abrasive particles. Preferably, the abrasive particles in the primary abrasive layer are homogenously distributed among each other, because the manufacture of the wheels is easier, and the cutting effect is optimized when the two types of abrasive particles are closely positioned to each other. Similarly, it is preferable that abrasive particles in the secondary abrasive layer are homogenously distributed among each other.

The abrasive particles may be treated with a coupling agent (e.g., an organosilane coupling agent) to enhance adhesion of the abrasive particles to the binder (e.g., the first and/or second organic binder). The abrasive particles may be treated before combining them with the binder, or they may be surface treated in situ by including a coupling agent to the binder.

Bonded abrasive wheels according to the present disclosure may further comprise one or more grinding aids (generally as particles) such as, for example, polytetrafluoroethylene particles, cryolite, potassium fluoroaluminate, sodium chloride, $FeS_2$ (iron disulfide), or $KBF_4$. If present, grinding aid is preferably included in an amount of from 1 to 25 percent by weight, and more preferably in an amount of from 10 to 20 percent by weight, subject to weight range requirements of the other constituents being met. Grinding aids are added to improve the cutting characteristics of the bonded abrasive wheel, generally by reducing the temperature of the cutting interface. Examples of precisely shaped grinding aid particles are taught in U.S. Pat. Appln. Publ. No. 2002/0026752 A1 (Culler et al.).

In some embodiments, the organic binder material contains plasticizer such as, for example, that available as SANTICIZER 154 PLASTICIZER from UNIVAR USA, Inc. of Chicago, Ill.

The primary abrasive layer and the secondary abrasive layer may contain additional components such as, for example, filler particles, subject to weight range requirements of the other constituents being met. Filler particles may be added to occupy space and/or provide porosity. Porosity enables the bonded abrasive wheel to shed used or worn abrasive particles to expose new or fresh abrasive particles.

The primary abrasive layer and the secondary abrasive layer may have any range of porosity; for example, from about 1 percent to 50 percent, typically 1 percent to 40 percent by volume. Examples of fillers include bubbles and beads (e.g., glass, ceramic (alumina), clay, polymeric, metal), cork, gypsum, marble, limestone, flint, silica, aluminum silicate, and combinations thereof.

Bonded abrasive wheels according to the present disclosure preferably have one or more additional layers or discs of reinforcing material integrally molded and bonded therein. One layer of reinforcing material is preferably bonded to and situated in between the secondary and primary abrasive layers of the wheel. In some embodiments, a central hub portion of the abrasive wheel adjacent the central hub may be further reinforced with a disc of fiberglass cloth molded in and bonded to the bottom side of the primary abrasive layer. As discussed hereinabove, bonded abrasive wheels according to the present disclosure may include one or more reinforcing materials (e.g., a woven fabric, a knitted fabric, a nonwoven fabric, and/or a scrim) that reinforces the bonded abrasive wheel. The reinforcing material may comprise inorganic fibers (e.g., fiberglass) and/or organic fibers such as polyamide fibers, polyester fibers, or polyimide fibers. In some instances, it may be desirable to include reinforcing staple fibers within the first and/or second organic binders so that the fibers are homogeneously dispersed throughout the cut-off wheel.

Bonded abrasive wheels may be molded to the shape of, for example, a shallow or flat dish or saucer with curved or straight flaring sides, and may have either a straight or depressed-center portion encircling and/or adjacent to a central hub (e.g., as in a Type 27 depressed-center abrasive wheel). The bonded abrasive wheel can be adapted adjacent to, or within, the central hub (i.e., a center mounting hole) to receive any suitable mounting or adapter, for example, for attaching the bonded abrasive wheel to the drive spindle or shaft of a portable grinder, for example, as described in U.S. Pat. No. 3,081,584 (Bullard); U.S. Pat. No. 3,136,100 (Robertson, Jr.); U.S. Pat. No. 3,500,592 (Harrist); and U.S. Pat. No. 3,596,415 (Donahue). There are many other types of suitable mountings known to those skilled in the art which may be attached in various ways to the abrasive wheels.

Bonded abrasive wheels according to the present disclosure can be made according to any suitable method. In one suitable method, a first reinforcing material is placed into a bonded mold centered over a circular magnet placed just below the mold. In this configuration the magnetic field lines in the center of the mold are perpendicular to the plane of the wheel, while the magnetic field lines at the edge of the wheel are preferably at an angle of 35 degrees or less, more preferably 20 degrees or less. Crushed abrasive particles are mixed with a liquid binder precursor and then a powdered binder precursor, and placed in the mold onto the scrim thereby forming a substantially uniform layer onto which a second reinforcing material is placed. Finally, a mixture of magnetizable abrasive particles, optional grinding aid, and a second liquid binder precursor and powdered binder precursor (as before) is placed on top of the second reinforcing material. At this point the mold may be agitated and/or allowed to rest for a period of time, to facilitate alignment of the magnetic abrasive particles with the magnetic field lines. Finally, mold is closed and pressed (e.g., at an applied pressure of 20 tons per 4 inches diameter (224 kg/cm$^2$) at room temperature. The molded abrasive wheel precursor is then heated at sufficient temperature (e.g., up to about 185° C.) for sufficient time to cure the binder precursors. After some cooling, the mold is opened and the bonded abrasive wheel removed.

Bonded abrasive wheels according to the present disclosure can be made according to any suitable method. In one suitable method, ceramic shaped abrasive particles are optionally coated with a coupling agent prior to mixing with a curable organic precursor. To the resulting mixture is added the curable organic precursor (preferably in liquid form) and any optional ingredients.

The mixture is pressed into a mold having a central hub disposed therein (e.g., at an applied pressure of 20 tons per 4 inches diameter (224 kg/cm$^2$) at room temperature.

Figure 4:
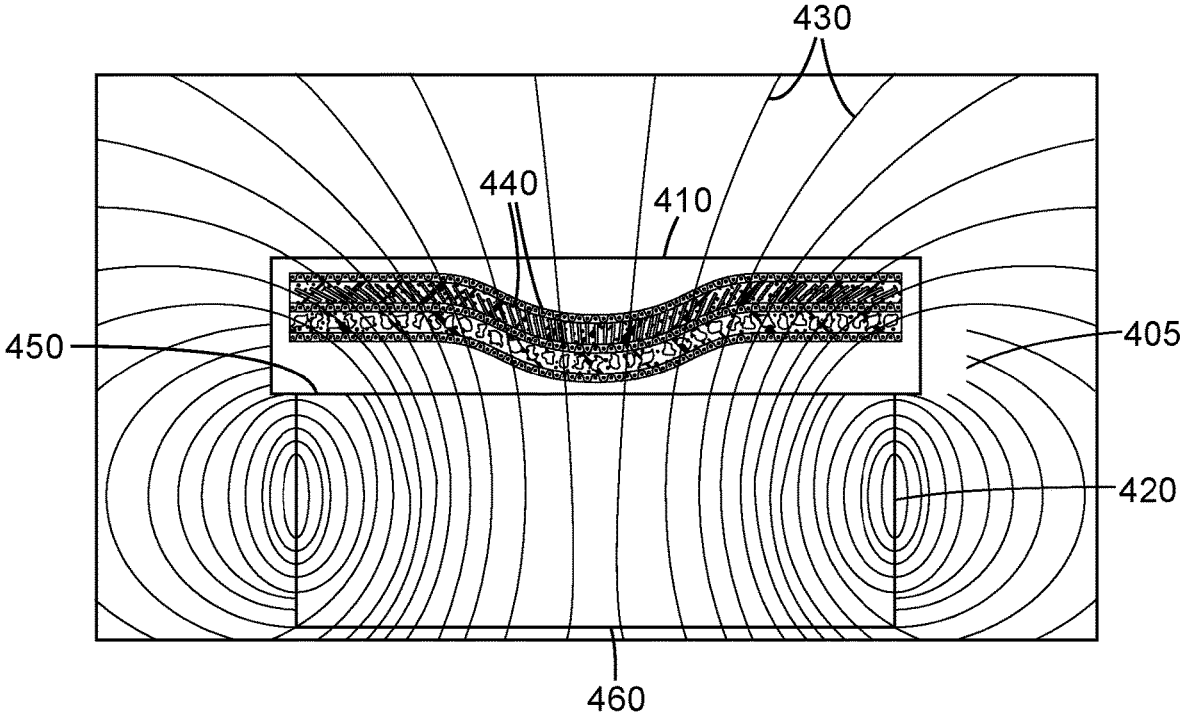
FIG. 4, is a schematic view showing how magnetic field lines orient magnetic abrasive particles in a mold cavity.

FIG. 4 shows schematically how magnetic field lines orient magnetic abrasive particles in a circular mold cavity. For ease of understanding, FIG. 4 represents a cross-section of a circular mold cavity and circular magnet. Circular external magnet 420, with north magnetic pole 450 and south magnetic pole 460, is disposed adjacent to mold 405 which has a circular mold cavity 410. Magnetic field lines 430 orient magnetizable abrasive particles 440 contained in a mixture of the magnetizable abrasive particles and binder precursor (not shown) within the mold cavity. Although, the orientation is generally flattened somewhat due to pressure applied during cure, the relative alignment gradient is maintained.

The magnetic field may be supplied by a permanent magnet and/or an electromagnet, for example. Typically, the viscosity of the binder precursor/magnetizable abrasive particles mixture and the dwell time in the magnetic field prior to curing is sufficient to allow the magnetizable abrasive particles to substantially align with the lines of magnetic force. In preferred embodiments, the orientation occurs adjacent to a single circular magnet, centered at and perpendicular to the rotational axis, such that the lines of magnetic force in the mold cavity become closer to the plane of the abrasive wheel with increasing distance from the rotational axis. Typically, the magnetizable abrasive particles will tend to align with their magnetizable layers substantially longitudinally aligned with lines of the applied magnetic force in the mold cavity. Their orientation is locked in placed after curing/hardening of the binder precursor.

The molded bonded abrasive wheel is then cured by heating at temperatures up to about 185° C. for sufficient time to cure the curable phenolic resins. Vitreous bond abrasive wheels are made in a similar manner, but the firing temperature is typically from 70 to 1100° C. instead of the lower temperatures sued for organic binder precursors.

Bonded abrasive wheels according to the present disclosure may be used, for example, as off-angle abrasive wheels such as abrasives industry Type 27 (e.g., as in American National Standards Institute standard ANSI B7.1-2000 (2000) in section 1.4.14) depressed-center abrasive wheels.

Bonded abrasive wheels typically have a thickness of 0.1 cm to 100 cm, more typically 1 cm to 10 cm, and typically have a diameter between about 1 cm and 100 cm, more typically between about 10 cm and 100 cm, although other dimensions may also be used. For example, bonded abrasive articles may be in the form of a cup wheel generally between 10 and 15 cm in diameter, or may be in the form of a snagging wheel of up to 100 cm in diameter, or may also be in the form of a bonded abrasive wheel of up to about 25 cm in diameter. A central hub (typically disposed around a center hole although this is not a requirement) is used for reinforcement and to attaching the abrasive wheel to a power driven tool. If present, the center hole is typically 0.5 cm to 2.5 cm in diameter, although other sizes may be used. The central hub may comprise, for example, a metal or plastic flange. Alternatively, a mechanical fastener may be axially secured to one surface of the bonded abrasive wheel. Examples include threaded posts.

In typical use, a bonded abrasive wheel according to the present disclosure is secured to a rotating powered tool and the primary abrasive layer is brought into frictional contact with a surface of a workpiece and at least a portion of the surface is abraded.

Advantageously, the modulus and/or thickness of the secondary abrasive layer can be varied, for example, by choosing the second organic binder to be different than the first organic binder and/or by adjusting the levels of other components in the secondary abrasive layer. For example, in some embodiments, the secondary abrasive layer is stiffer than the primary abrasive layer, while in other embodiments the primary abrasive layer is stiffer than the secondary abrasive layer.

Bonded abrasive wheels can be used on an off-angle grinding tool such as, for example, those available from Ingersoll-Rand, Sioux, Milwaukee, and Cooper Power Tools of Lexington, S.C. The tool can be electrically or pneumatically driven, generally at speeds from about 1000 to 50000 RPM.

Bonded abrasive wheels according to the present disclosure are generally useful for abrading a workpiece. The workpiece may comprise any material and may have any form. Examples of workpiece materials include metals (e.g., carbon steel, stainless steel, titanium, mild steel, low alloy steels, cast irons, and metal alloys), ceramics, painted surfaces, plastics, polymeric coatings, stone, polycrystalline silicon, wood, marble, and combinations thereof. Examples of workpieces include metal bar and/or stock and welded seams.

In typical use, a bonded abrasive wheel according to the present disclosure is secured to a rotating powered tool and the primary abrasive layer is brought into frictional contact with a surface of a workpiece and at least a portion of the surface is abraded. During use, the bonded abrasive wheels can be used dry or wet. During wet grinding, the bonded abrasive wheel is typically used in conjunction with water, oil-based lubricants, surfactant solutions, or water-based lubricants.

SELECT EMBODIMENTS OF THE PRESENT DISCLOSURE

In a first embodiment, the present disclosure provides a bonded abrasive wheel comprising magnetizable abrasive particles retained in a first organic binder, wherein the bonded abrasive wheel has a central portion adjacent to a central hub, wherein the bonded abrasive wheel has an outer circumference and a rotational axis extending through the central hub, wherein the magnetizable abrasive particles adjacent to the central hub are aligned at an average angle of less than 35 degrees with respect to the rotational axis, and wherein the magnetizable abrasive particles adjacent to the outer circumference of the bonded abrasive wheel are aligned at an average angle that is from 35 and 90 degrees, inclusive, with respect to the rotational axis.

In a second embodiment, the present disclosure provides a bonded abrasive wheel according to the first embodiment, wherein the bonded abrasive wheel comprises:

a primary abrasive layer comprising the magnetizable abrasive particles retained in the first organic binder;

a secondary abrasive layer comprising non-magnetizable abrasive particles retained in a second organic binder; and a first reinforcing material disposed between and contacting the primary abrasive layer and the secondary abrasive layer.

In a third embodiment, the present disclosure provides a bonded abrasive wheel according to the second embodiment, further comprising a second reinforcing material contacting the secondary abrasive layer opposite the first reinforcing material.

In a fourth embodiment, the present disclosure provides a bonded abrasive wheel according to any one of the first to third embodiments, wherein the magnetizable abrasive particles comprise ceramic bodies, each having a respective magnetizable layer disposed thereon.

In a fifth embodiment, the present disclosure provides a bonded abrasive wheel according to the fourth embodiment, wherein the ceramic bodies comprise alpha alumina.

In a sixth embodiment, the present disclosure provides a bonded abrasive wheel according to the fourth embodiment, wherein the ceramic bodies comprise ceramic rods.

In a seventh embodiment, the present disclosure provides a bonded abrasive wheel according to the fourth embodiment, wherein the ceramic bodies comprise ceramic platelets.

In an eighth embodiment, the present disclosure provides a bonded abrasive wheel according to the seventh embodiment, wherein the ceramic platelets comprise ceramic truncated triangular pyramids.

In a ninth embodiment, the present disclosure provides a bonded abrasive wheel according to any one of the first to eighth embodiments, wherein the magnetizable layer consists essentially of a metal or metal alloy.

In a tenth embodiment, the present disclosure provides a bonded abrasive wheel according to any one of the first to eighth embodiments, wherein the magnetizable layer comprises magnetizable particles retained in a binder.

In an eleventh embodiment, the present disclosure provides a method of making a bonded abrasive wheel, the method comprising steps:

a) disposing a layer of a first curable composition into a mold having a circular mold cavity with a central portion adjacent to a central hub, wherein the circular mold cavity has an outer circumference and a rotational axis extending through the central hub, and wherein the curable composition comprises non-magnetizable abrasive particles dispersed in a first organic binder precursor;

b) disposing a first porous reinforcing material onto the layer of first curable composition;

c) disposing a layer of a second curable composition onto the porous reinforcing material and first curable composition, wherein the second curable composition comprises magnetizable abrasive particles dispersed in a second organic binder precursor; and d) applying a magnetic field to the curable composition such that the magnetizable abrasive particles adjacent to the central hub are aligned at an average angle of less than 35 degrees with respect to the rotational axis, and wherein the magnetizable abrasive particles adjacent to the outer circumference of the circular mold cavity are aligned at an average angle that is from 35 and 90 degrees, inclusive, with respect to the rotational axis; and e) at least partially curing the curable composition to provide the bonded abrasive wheel.

In a twelfth embodiment, the present disclosure provides a method according to the eleventh embodiment, wherein prior to step a) a second porous reinforcing material is placed in the circular mold cavity, and wherein the layer of the first curable composition is disposed on the second reinforcing material.

In a thirteenth embodiment, the present disclosure provides a method according to the eleventh or twelfth embodiment, further comprising separating the bonded abrasive wheel from the mold.

In a fourteenth embodiment, the present disclosure provides a method according to any one of the eleventh to thirteenth embodiments, wherein steps a) and b) are simultaneous.

In a fifteenth embodiment, the present disclosure provides a method according to any one of the eleventh to thirteenth embodiments, wherein steps b) and c) are simultaneous.

In a sixteenth embodiment, the present disclosure provides a method according to any one of the eleventh to fifteenth embodiments, wherein step c) further comprises compressing the layers of the first and second curable compositions.

In a seventeenth embodiment, the present disclosure provides a method according to any one of the eleventh to sixteenth embodiments, wherein step b) further comprises mechanically agitating at least the layer of the second curable composition.

In an eighteenth embodiment, the present disclosure provides a method according to any one of the eleventh to seventeenth embodiments, wherein the magnetizable abrasive particles comprise ceramic bodies, each having a respective magnetizable layer disposed thereon.

In a nineteenth embodiment, the present disclosure provides a method according to the eighteenth embodiment, wherein the ceramic bodies comprise ceramic rods.

In a twentieth embodiment, the present disclosure provides a method according to the eighteenth embodiment, wherein the ceramic bodies comprise ceramic platelets.

In a twenty-first embodiment, the present disclosure provides a method according to the twentieth embodiment, wherein the ceramic platelets comprise ceramic truncated triangular pyramids.

In a twenty-second embodiment, the present disclosure provides a method according to any one of the eighteenth to twenty-first embodiments, wherein the magnetizable layer consists essentially of a metal or metal alloy.

In a twenty-third embodiment, the present disclosure provides a method according to any one of the eighteenth to twenty-first embodiments, wherein the magnetizable layer comprises magnetizable particles retained in a binder.

In a twenty-third embodiment, the present disclosure provides a method according to any one of the eighteenth to twenty-third embodiments, wherein the ceramic bodies comprise alpha alumina.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight. Unless stated otherwise, all other reagents were obtained, or are available from fine chemical vendors such as Sigma-Aldrich Company, St. Louis, Mo., or may be synthesized by known methods.

Materials used in the Examples are described in Table 1, below.

TABLE 1

| ABBREVIATION | DESCRIPTION |
|---|---|
| AO | grade 24 aluminum oxide abrasive particles available as 24 BFRPL from Treibacher Schleifmettel AG, Villach, Austria. |
| PAF | potassium fluoroaluminate, particle size distribution $d_{10}$ = 2.58 micrometers, $d_{50}$ = 11.5 micrometers, $d_{90}$ = 36.6 micrometers, from KBM Afflips B.V., Oss, The Netherlands. |
| PRL | liquid phenolic resin, available as DYNEA 5136G from Dynea Oy Corporation, Helsinki, Finland. |
| PRP | phenolic resin powder, available as VARCUM 29302 from Durez Corporation, Dallas, Texas. |
| PMIX | 50:50 blend of PAF and PRP mixed in a V-blender for 3 hours. |
| SAP1 | Shaped abrasive particle (rod) prepared according to the procedure in Preparation of SAP1 described below. |
| SAP2 | Shaped abrasive particles were prepared according to the disclosure of U.S. Pat. No. 8,142,531 (Adefris et al). The shaped abrasive particles were prepared by molding alumina sol gel in equilateral triangle-shaped polypropylene mold cavities. After drying and firing, the resulting shaped abrasive particles were about 2.5 mm (side length) × 0.5 mm (thickness), with a draft angle approximately 98 degrees. |
| SCRIM1 | fiberglass mesh obtained as STYLE 4400 from Industrial Polymer and Chemicals, Inc., Shrewsbury, Massachusetts. |
| SCRIM2 | fiberglass mesh from Tissa Glasweberei AG, Oberkulm, Switzerland. |

Preparation of SAP1

Figure 9A:
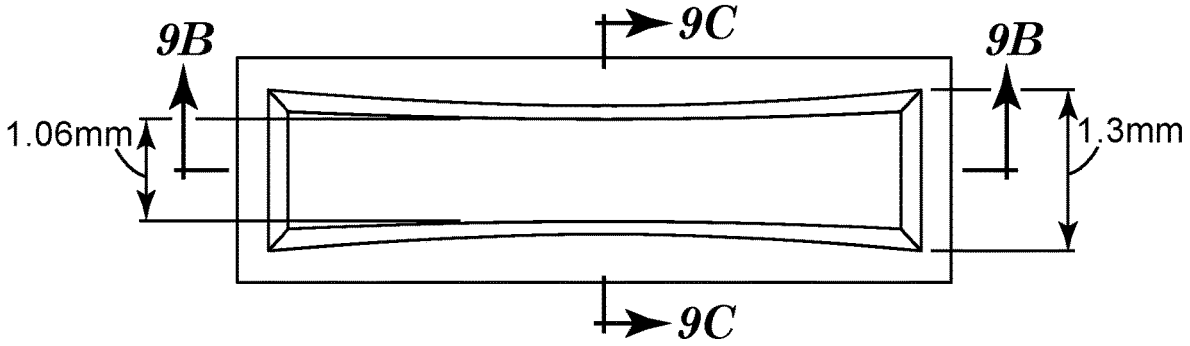
FIG. 9A is a schematic top view of a representative mold cavity 900 in mold 910 used to make particles SAP1.
Figure 9B:
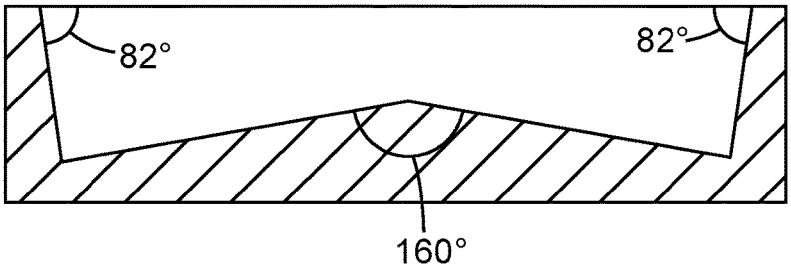
FIG. 9B is a schematic cross-sectional side view of mold cavity 900 taken along line 9B-9B in FIG. 9A.
Figure 9C:
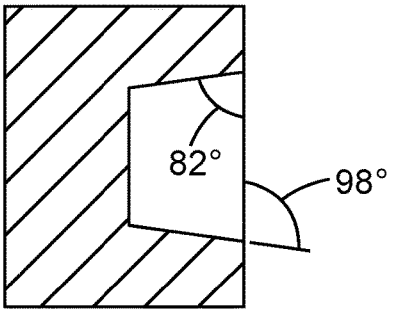
FIG. 9C is a schematic cross-sectional view of mold cavity 900 taken along line 9C-9C in FIG. 9A.

A sample of boehmite sol-gel was made using the following recipe: aluminum oxide monohydrate powder (1600 parts, obtained under the trade designation of "DISPERAL") was dispersed by high shear mixing a solution containing deionized water (2400 parts) and 70% aqueous nitric acid (72 parts). The resulting sol-gel was aged for 1 hour. The resulting sol-gel was forced into a mold having a topical coating of peanut oil. Views of the mold cavity 900 in mold 910 are shown in FIGS. 9A-9C, wherein nominal dimensions and angles are indicated. The sol-gel was spread to the sheet using a putty knife so that the cavities were completely filled. The sheet containing the sol-gel was then air dried for two hours. Following drying, the sheet was shaken to dislodge the resulting precursor shaped particles.

The precursor shaped abrasive particles were then calcined by heating them to approximately 650° C. in air for 15 minutes. The particles were then saturated with a mixed nitrate solution of the following concentration (reported as oxides): 1.8% each of MgO, $Y_2O_3$, $Nd_2O_3$ and $La_2O_3$. The excess nitrate solution was removed and the saturated precursor shaped abrasive particles were allowed to dry after which the particles were again calcined at 650° C. and sintered at approximately 1400° C. Both the calcining and sintering was performed using rotary tube kilns.

Example 1

Preparation of Magnetizable Abrasive Particles (MAP1)

SAP1 was coated with 304 stainless steel using physical vapor deposition with magnetron sputtering, 304 stainless steel sputter target, described by Barbee et al. in *Thin Solid Films,* 1979, vol. 63, pp. 143-150, deposited as the magnetic ferritic body centered cubic form. The apparatus used for the preparation of 304 stainless steel film coated abrasive particles (i.e., magnetizable abrasive particles) was disclosed in U.S. Pat. No. 8,698,394 (McCutcheon et al.). 1631 grams of SAP1 were placed in a particle agitator that was disclosed in U.S. Pat. No. 7,727,931 (Brey et al, Column 13, line 60). The physical vapor deposition was carried out for 10 hours at 5.0 kilowatt at an argon sputtering gas pressure of 10 millitorr (1.33 pascal) onto SAP1. The density of the coated SAP1 was 3.9876 grams per cubic centimeter (the density of the uncoated SAP1 was 3.9013 grams per cubic centimeter). The weight percentage of metal coating in the MAP1 coated abrasive particles was 2.2 wt. %.

Preparation of Mixes

Mixes were prepared according to the composition listed in Table 2. Each mix was prepared by first mixing AO or MAP1 with PRL for 7 minutes in a paddle mixer, then the PMIX powder blend was added and mixed for 7 additional minutes.

TABLE 2

| | Amount, grams | |
|---|---|---|
| Component | Mix 1 | Mix 2 |
| AO | 720 | — |
| MAP1 | — | 720 |
| PMIX | 225 | 225 |
| PRL | 55 | 55 |

A Type 27 depressed-center composite grinding wheel was prepared as follows. A 4.5-inch diameter (11.4-cm) mold made of 304 stainless steel was placed on top of a 6-inch (15.2-cm) diameter×2-inch (5.1-cm) thick neodymium magnet with an average surface field strength of 0.6 Tesla. A 4.5-inch (11.4 cm) diameter disc of SCRIM1 was placed into the mold. Mix 1 (75 grams) was spread out evenly and a second 4.5-inch (11.4-cm) disc of SCRIM1 was placed on top of the mix 1. Mix 2 (75 grams) was spread out evenly on the second scrim. A 3-inch (7.6-cm) SCRIM2 disc was inserted and centered into the cavity. The filled cavity mold was then pressed at a pressure of 30 tons. The resulting wheel was removed from the cavity mold and placed on a spindle between depressed-center aluminum plates in order to be pressed into a Type 27 depressed-center grinding wheel. The wheel was compressed at 5 tons to shape the disc. The wheel was then placed in an oven to cure for 7 hours at 79° C., 3 hours at 107° C., 18 hours at 185° C., and a temperature ramp-down over 4 hours to 27° C. The dimensions of the final grinding wheel were 114.3 mm diameter×6.35 mm thickness. The center hole was ⅞ inch (2.2 cm) in diameter.

Figure 5:
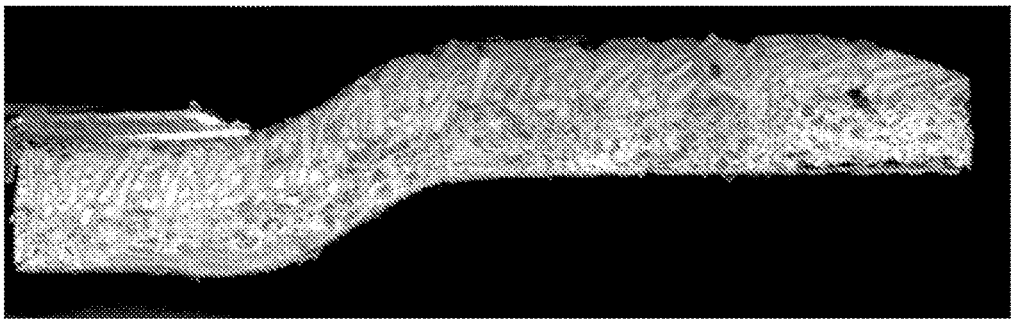
FIG. 5 is a photograph of a cross-section of the depressed-center abrasive wheel made in Example 1.

The abrasive particles in the resulting grinding wheel were oriented upward; fanning outward the further away from the center of the wheel they were located, as shown in FIG. 5.

Comparative Example A

The procedure described above in EXAMPLE 1 was repeated, except that the procedure was carried out without ever being subjected to the magnetic field.

Figure 6:
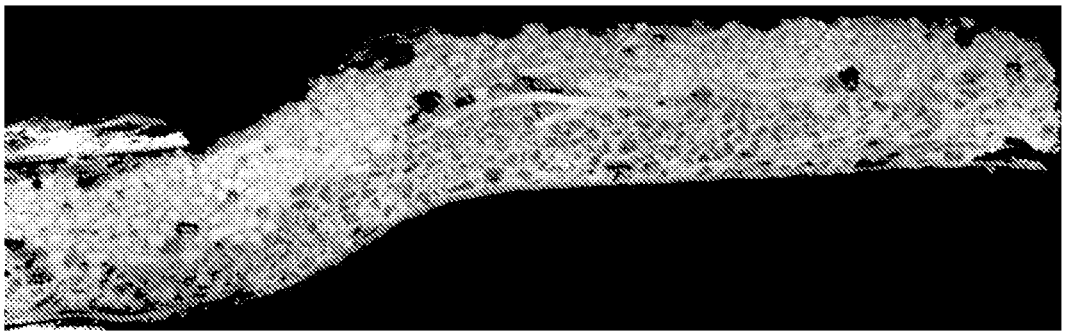
FIG. 6 is a photograph of a cross-section of the depressed-center abrasive wheel made in Comparative Example A.

FIG. 6 shows the resulting depressed-center abrasive wheel in cross-section.

Performance Test

The wheels were mounted on an Atlas Copco GTG25 pneumatic grinder which was in turn mounted to a robotic arm to precisely control movement. The wheels were tested grinding against a 1018 cold rolled steel workpiece with 2-inch (5.18-cm) height, 0.25-inch (0.64-cm) thickness and 18-inch (45.72-cm) length. The abrasive article was then urged at an angle of 12.5 degrees against the workpiece at a load of 9 pounds (4.08 kilograms). The grinder continuously traversed back and forth across the entire steel bar on the 0.25-inch edge. The wheel was tested for 10 minutes. The mass of the workpiece was measured before and after the test to determine the cut in grams. The wheel was weighed before and after the test to determine the wear in grams. G-ratio was calculated as the ratio of cut to wear. The results are shown in Table 3.

TABLE 3

| | CUT, grams | WHEEL WEAR, grams | G RATIO |
|---|---|---|---|
| COMPARATIVE EXAMPLE A | 326.91 | 4.42 | 74 |
| EXAMPLE 1 | 658.33 | 8.09 | 81 |

Example 2

Preparation of Magnetizable Abrasive Particles (MAP2)

SAP2 was coated with 304 stainless steel using physical vapor deposition with magnetron sputtering, 304 stainless steel sputter target, described by Barbee et al. in *Thin Solid Films,* 1979, vol. 63, pp. 143-150, deposited as the magnetic ferritic body centered cubic form. The apparatus used for the preparation of 304 stainless steel film coated abrasive particles (i.e., magnetizable abrasive particles) was disclosed in U.S. Pat. No. 8,698,394 (McCutcheon et al.). 3592 grams of SAP2 were placed in a particle agitator that was disclosed in U.S. Pat. No. 7,727,931 (Brey et al. at Col. 13, line 60). The blade end gap distance to the walls of the agitator was 1.7 mm. The physical vapor deposition was carried out for 12 hours at 5.0 kilowatts at an argon sputtering gas pressure of 10 millitorr (1.33 pascal) onto SAP2. The density of the coated SAP2 was 3.912 grams per cubic centimeter (the density of the uncoated SAP2 was 3.887 grams per cubic centimeter). The weight percentage of metal coating in the coated abrasive particles was 0.65% and the coating thickness is 1 micron.

Preparation of Mixes

Mixes were prepared according to the composition listed in Table 4. Each mix was prepared by first mixing AO or SAP2 with PRL for 7 minutes in a paddle mixer, then the PMIX powder blend was added and mixed for 7 additional minutes.

TABLE 4

| | Amount, grams | | |
|---|---|---|---|
| Component | Mix 1 | Mix 2 | Mix 3 |
| AO | 720 | — | — |
| SAP2 (uncoated) | — | 720 | — |
| MAP2 | — | — | 720 |
| PMIX | 225 | 225 | 225 |
| PRL | 55 | 55 | 55 |

A Type 27 depressed-center composite grinding wheel was prepared as follows. A 4.5-inch diameter (11.43-cm) mold made of 304 stainless steel was placed on top of a 6-inch (15.24-cm) diameter×2-inch (5.08-cm) thick neodymium magnet with an average surface field strength of 0.6 Tesla. A 4.5-inch (11.4 cm) diameter disc of SCRIM1 was placed into the mold. Mix 1 (75 grams) was spread out evenly and a second 4.5-inch (11.4-cm) disc of SCRIM' was placed on top of the mix 1. Mix 3 (75 grams) was spread out evenly on the second scrim. A 3-inch (7.6-cm) SCRIM2 disc was inserted and centered into the cavity. The filled cavity mold was then pressed at a pressure of 30 tons. The resulting wheel was removed from the cavity mold and placed on a spindle between depressed-center aluminum plates in order to be pressed into a Type 27 depressed-center grinding wheel. The wheel was compressed at 5 tons to shape the disc. The wheel was then placed in an oven to cure for 7 hours at 79° C., 3 hours at 107° C., 18 hours at 185° C., and a temperature ramp-down over 4 hours to 27° C. The dimensions of the final grinding wheel were 114.3 mm diameter×6.35 mm thickness. The center hole was ⅞ inch (2.2 cm) in diameter.

Figure 7:
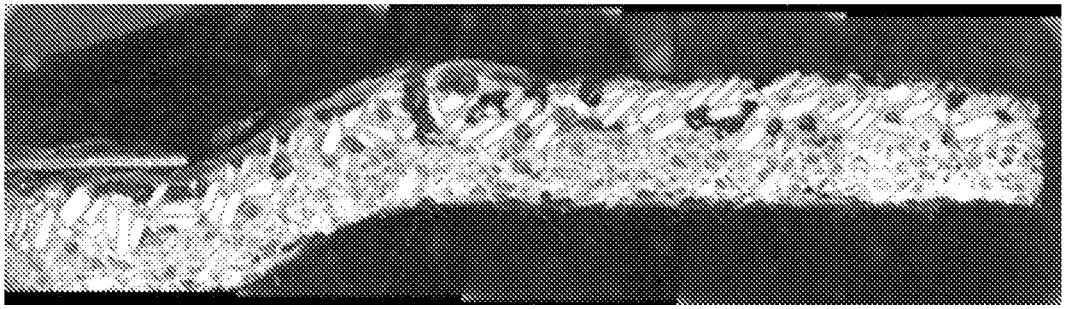
FIG. 7 is a photograph of a cross-section of the depressed-center abrasive wheel made in Example 2.

The orientation of the abrasive particles in the resulting grinding wheel are shown in FIG. 7.

Comparative Example B

The procedure described above in EXAMPLE 2 was repeated, except that the procedure was carried out without ever being subjected to the magnetic field.

Figure 8:
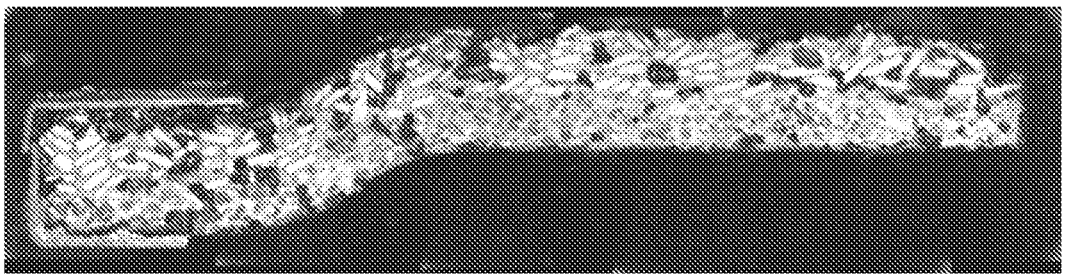
FIG. 8 is a photograph of a cross-section of the depressed-center abrasive wheel made in Comparative Example B.

The orientation of the abrasive particles in the resulting grinding wheel are shown in FIG. 8.

Comparative Example C

The procedure described above in COMPARATIVE EXAMPLE B was repeated, except that Mix 3 (75 grams) was replaced with Mix 2 (75 grams).

Performance Test

The wheels were mounted on an Atlas Copco GTG25 pneumatic grinder which was in turn mounted to a robotic arm to precisely control movement. The wheels were tested grinding against a 1018 cold rolled steel workpiece with 2-inch (5.18-cm) height, 0.25-inch (0.64-cm) thickness and 18-inch (45.72-cm) length. The abrasive article was then urged at an angle of 12.5 degrees against the workpiece at a load of 9 pounds (4.08 kilograms). The grinder continuously traversed back and forth across the entire steel bar on the 0.25-inch edge. The wheel was tested for 10 minutes. The mass of the workpiece was measured before and after the test to determine the cut in grams. The wheel was weighed before and after the test to determine the wear in grams. G-ratio was calculated as the ratio of cut to wear. The results are shown in Table 5, below.

TABLE 5

| | CUT, grams | WHEEL WEAR, grams | G RATIO |
|---|---|---|---|
| EXAMPLE 2 | 360 | 2.08 | 173.1 |
| COMPARATIVE EXAMPLE B | 355 | 6.26 | 56.7 |
| COMPARATIVE EXAMPLE C | 343 | 4.06 | 84.5 |

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A bonded abrasive wheel comprising magnetizable abrasive particles retained in a first organic binder, wherein the bonded abrasive wheel has a central portion adjacent to a central hub, wherein the bonded abrasive wheel has an outer circumference and a rotational axis extending through the central hub, wherein the magnetizable abrasive particles adjacent to the central hub are aligned at an average angle of less than 35 degrees with respect to the rotational axis, and wherein the magnetizable abrasive particles adjacent to the outer circumference of the bonded abrasive wheel are aligned at an average angle that is from 35 and 90 degrees, inclusive, with respect to the rotational axis.

2. The bonded abrasive wheel of claim 1, wherein the bonded abrasive wheel comprises:

a primary abrasive layer comprising the magnetizable abrasive particles retained in the first organic binder;

a secondary abrasive layer comprising non-magnetizable abrasive particles retained in a second organic binder; and a first reinforcing material disposed between and contacting the primary abrasive layer and the secondary abrasive layer.

3. The bonded abrasive wheel of claim 2, further comprising a second reinforcing material contacting the secondary abrasive layer opposite the first reinforcing material.

4. The bonded abrasive wheel of claim 1, wherein the magnetizable abrasive particles comprise ceramic bodies, each having a respective magnetizable layer disposed thereon.

5. The bonded abrasive wheel of claim 4, wherein the ceramic bodies comprise alpha alumina.

6. The bonded abrasive wheel of claim 4, wherein the ceramic bodies comprise ceramic truncated triangular pyramids.

7. The bonded abrasive wheel of claim 4, wherein the magnetizable layer consists essentially of a metal or metal alloy.

8. The bonded abrasive wheel of claim 4, wherein the magnetizable layer comprises magnetizable particles retained in a binder.

9. A method of making a bonded abrasive wheel, the method comprising steps:

a) disposing a layer of a first curable composition into a mold having a circular mold cavity with a central portion adjacent to a central hub, wherein the circular mold cavity has an outer circumference and a rotational axis extending through the central hub, and wherein the curable composition comprises non-magnetizable abrasive particles dispersed in a first organic binder precursor;

b) disposing a first porous reinforcing material onto the layer of first curable composition;

c) disposing a layer of a second curable composition onto the porous reinforcing material and first curable composition, wherein the second curable composition comprises magnetizable abrasive particles dispersed in a second organic binder precursor; and d) applying a magnetic field to the curable composition such that the magnetizable abrasive particles adjacent to the central hub are aligned at an average angle of less than 35 degrees with respect to the rotational axis, and wherein the magnetizable abrasive particles adjacent to the outer circumference of the circular mold cavity are aligned at an average angle that is from 35 and 90 degrees, inclusive, with respect to the rotational axis; and e) at least partially curing the curable composition to provide the bonded abrasive wheel.

10. The method of claim 9, wherein prior to step a) a second porous reinforcing material is placed in the circular mold cavity, and wherein the layer of the first curable composition is disposed on the second reinforcing material.

11. The method of claim 9, further comprising separating the bonded abrasive wheel from the mold.

12. The method of claim 9, wherein steps a) and b) are simultaneous.

13. The method of claim 9, wherein steps b) and c) are simultaneous.

14. The method of claim 9, wherein step c) further comprises compressing the layers of the first and second curable compositions.

15. The method of claim 9, wherein step b) further comprises mechanically agitating at least the layer of the second curable composition.

16. The method of claim 9, wherein the magnetizable abrasive particles comprise ceramic bodies, each having a respective magnetizable layer disposed thereon.

17. The method of claim 16, wherein the ceramic bodies comprise ceramic truncated triangular pyramids.

18. The method of claim 16, wherein the magnetizable layer consists essentially of a metal or metal alloy.

19. The method of claim 16, wherein the magnetizable layer comprises magnetizable particles retained in a binder.

20. The method of claim 16, wherein the ceramic bodies comprise alpha alumina.

* * * * *